US010316800B2

(12) United States Patent
Yang et al.

(10) Patent No.: US 10,316,800 B2
(45) Date of Patent: Jun. 11, 2019

(54) MODULAR FUEL VAPOR CANISTER

(71) Applicant: Ford Global Technologies, LLC, Dearborn, MI (US)

(72) Inventors: Dennis Seung-Man Yang, Canton, MI (US); Aed M. Dudar, Canton, MI (US); Russell Randall Pearce, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 302 days.

(21) Appl. No.: 15/155,979

(22) Filed: May 16, 2016

(65) Prior Publication Data

US 2016/0341156 A1 Nov. 24, 2016

Related U.S. Application Data

(60) Provisional application No. 62/165,692, filed on May 22, 2015.

(51) Int. Cl.
*F02M 25/08* (2006.01)
*F02D 41/00* (2006.01)

(52) U.S. Cl.
CPC ..... *F02M 25/0854* (2013.01); *F02D 41/0045* (2013.01); *F02M 25/0809* (2013.01); *F02D 2200/0606* (2013.01); *F02M 2025/0881* (2013.01)

(58) Field of Classification Search
CPC ..... F02M 25/0854; F02M 25/0836; F02M 25/089; B60K 2015/03514
See application file for complete search history.

(56) References Cited

U.S. PATENT DOCUMENTS

| | | | | |
|---|---|---|---|---|
| 4,962,744 | A * | 10/1990 | Uranishi | F02M 25/0809 123/198 D |
| 5,150,689 | A * | 9/1992 | Yano | F02M 25/0809 123/198 D |
| 5,564,398 | A | 10/1996 | Maeda et al. | |
| 5,921,222 | A | 7/1999 | Freeland | |
| 6,540,815 | B1 | 4/2003 | Hiltzik et al. | |
| 7,233,845 | B2 | 6/2007 | Veinotte | |
| 7,322,343 | B2 | 1/2008 | Yamada et al. | |
| 2015/0337775 | A1 * | 11/2015 | Dudar | F02M 25/089 123/520 |

* cited by examiner

*Primary Examiner* — Sizo B Vilakazi
(74) *Attorney, Agent, or Firm* — Julia Voutyras; McCoy Russell LLP

(57) ABSTRACT

Methods and systems are provided for a fuel vapor canister with a modular configuration that may include a number of physically and releasably coupled canister modules, each module including a temperature sensor embedded therein and filled with one of a number of adsorbents. The temperature sensors may be utilized in combination with information regarding module position and the adsorbents within each module to indicate whether one or more of the individual canister modules are not functioning as desired, where such indications are determined during either refueling events, or during canister purging events. In this way, costs associated with servicing fuel vapor canisters may be reduced, the lifetime of fuel vapor canisters may be improved, an overall reduction in undesired evaporative emissions may be achieved, and the capacity of the canister may be readily adjusted based on emissions standards.

15 Claims, 8 Drawing Sheets

MODULAR FUEL VAPOR CANISTER

CROSS REFERENCE TO RELATED APPLICATION

The present application claims priority to U.S. Provisional Patent Application No. 62/165,692, entitled "Modular Fuel Vapor Canister," filed on May 22, 2015, the entire contents of which are hereby incorporated by reference for all purposes.

FIELD

The present description relates generally to methods and systems for a modular configuration of a fuel vapor canister.

BACKGROUND/SUMMARY

Fuel vapor canisters are utilized in fuel systems to capture fuel vapors that arise within the fuel tank. Specifically, a first conduit may couple the fuel tank to the fuel vapor canister to allow for a migration of fuel vapors away from the fuel tank. These canisters are filled with an adsorbent such as activated carbon so as to trap the fuel vapors within the canister. A second conduit coupling the canister to an engine intake and a third conduit coupling the canister to a fresh air source allows for the trapped fuel vapors to be recycled into the combustion chambers while loading fresh air onto the adsorbent. The second conduit includes a canister purge valve for allowing vapors to escape the canister via the manifold vacuum during select conditions. One condition during which it is desirable to purge the fuel vapor canister is when the adsorbent reaches a percentage of full saturation or full saturation.

A temperature sensor may be included within the fuel vapor canister to determine the saturation level of a canister. Specifically, it is well known in the art that the temperature within the vapor canister increases as the loading state (e.g., the amount of fuel vapor deposited on the adsorbent therein) increases. Similarly, as a canister is purged, the temperature decreases and may reach a stable base temperature as the amount of fuel vapor within the canister approaches zero. Thus, a loading state may be estimated based on a temperature signal from a sensor within the vapor canister.

However, vapor adsorption rates may not be uniform within a fuel vapor canister, at least for the reasons of uneven airflow within the canister and the relative positioning of the aforementioned conduits. Thus, an estimate of loading state based on a single temperature sensor may be inaccurate due to a limited sensing range within the canister. For example, if the temperature sensor is placed at a location where vapor is adsorbed more rapidly, the temperature may indicate a fully saturated canister when other areas despite other areas in the canister being only partially saturated.

Other attempts to address managing adsorption levels within a fuel vapor canister include utilizing a plurality of temperature sensors along the canister flow path to determine adsorption at various points therein. One example approach is shown by Veinotte in U.S. Pat. No. 7,233,845. Therein, a fuel vapor canister includes a plurality of temperature sensors are installed along a flow path of the canister to determine adsorption levels at a plurality of locations along the flow path.

However, the inventors herein have recognized potential issues with such systems. As one example, due to the curved flow path of the canister, the temperature sensors must be disposed at carefully measured lengths within the adsorbent in order to measure different locations along the adsorption front, thereby introducing an undesirable degree of complexity to the manufacturing process. Additionally, due to the inclusion of each of the temperature sensors on a common printed circuit board and common electrical lead, maintenance costs of the plurality of temperature sensors of the canister of Veinotte may be high. Specifically, degradation of a single temperature sensor may require replacing each of the temperature sensors rather than only the degraded sensor.

Thus, the inventors herein have developed systems and methods to at least partially address the above issues. In one example a method is provided, comprising adsorbing fuel vapors or desorbing fuel vapors in a plurality of individual vapor storage modules which are coupled to a vehicle fuel tank; monitoring a plurality of temperature sensors each coupled to one of the individual modules; and indicating that one or more of the individual modules are not functioning as desired responsive to a monitored temperature change being different than an expected temperature change during the adsorbing or desorbing of fuel vapors.

As one example, prior to the adsorbing or desorbing of fuel vapors in the individual vapor storage modules, a loading state of each individual module is recorded, where the loading state includes an indication of a fuel vapor saturation level within each individual module. With the loading state of each individual module recorded, the expected temperature change is based on the loading state, and is further based on an expected amount of fuel vapors adsorbed or desorbed by individual modules during the adsorbing or desorbing. In some examples, adsorbing fuel vapors in the individual vapor storage modules occurs during refueling of the vehicle fuel tank, where fuel vapors generated during the refueling are directed to the individual vapor storage modules for adsorption, and wherein adsorbing fuel vapors results in a temperature increase in one or more of the plurality of individual vapor storage modules. Furthermore, in some examples, desorbing fuel vapors in the individual vapor storage modules occurs during a purge event, where the purge event further comprises coupling the individual vapor storage modules to an engine intake manifold and to atmosphere to draw fresh air across the individual vapor storage modules such that stored fuel vapors are desorbed and routed to the engine intake manifold for combustion, and wherein desorbing fuel vapors results in a temperature decrease in one or more of the plurality of individual vapor storage modules. In this way during a refueling event, or during a purging event, individual canister modules within a modular fuel vapor canister may be reliably assessed as to whether each individual canister module is functioning as desired. By enabling an ability to diagnose the functionality of individual modules, in a case where it is determined that one or more modules are not functioning as desired, only the modules that are not functioning as desired may be serviced and/or replaced, which may thus reduce overall servicing costs and replacement costs.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 4:
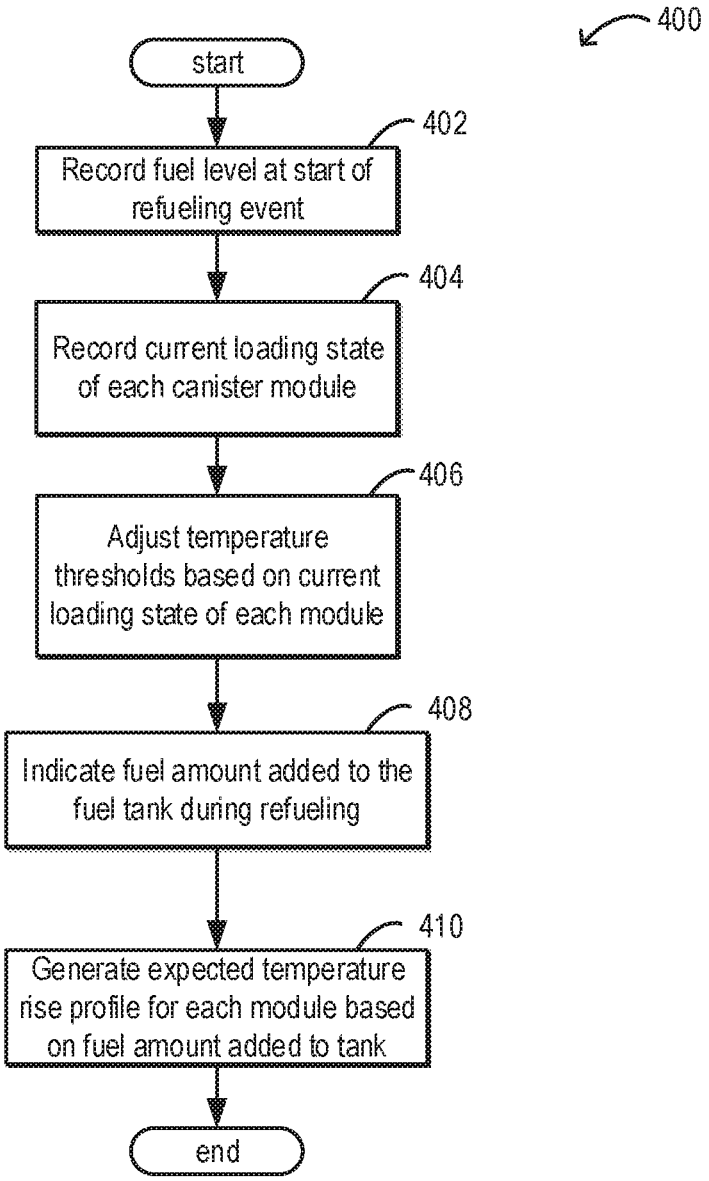
FIG. 4 shows an example routine for generating expected temperature profiles for each module of a modular fuel vapor canister for a refueling event.
Figure 5:
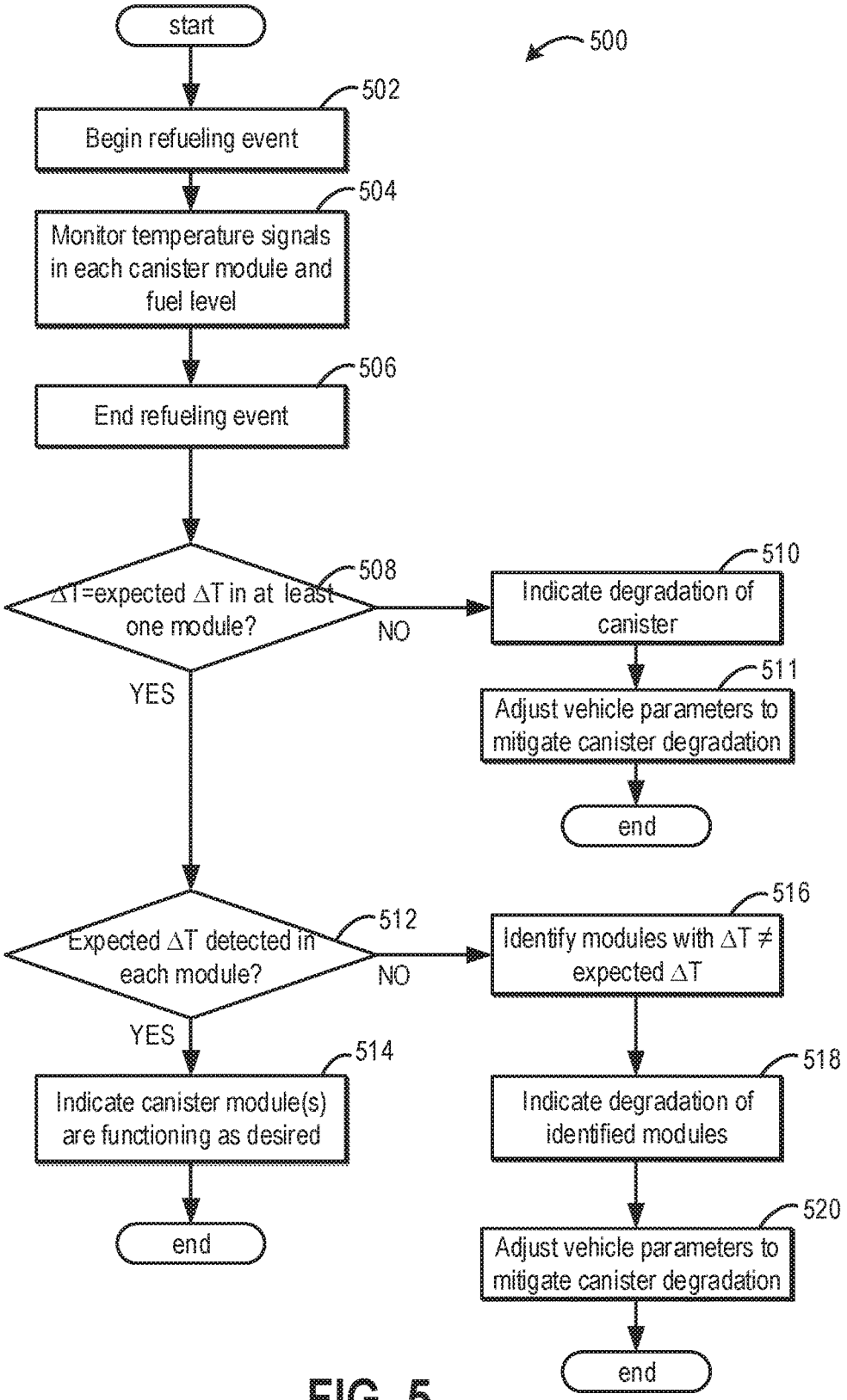
FIG. 5 shows an example routine for diagnosing the functionality of individual canister modules in a modular fuel vapor canister during a fueling event.
Figure 6:
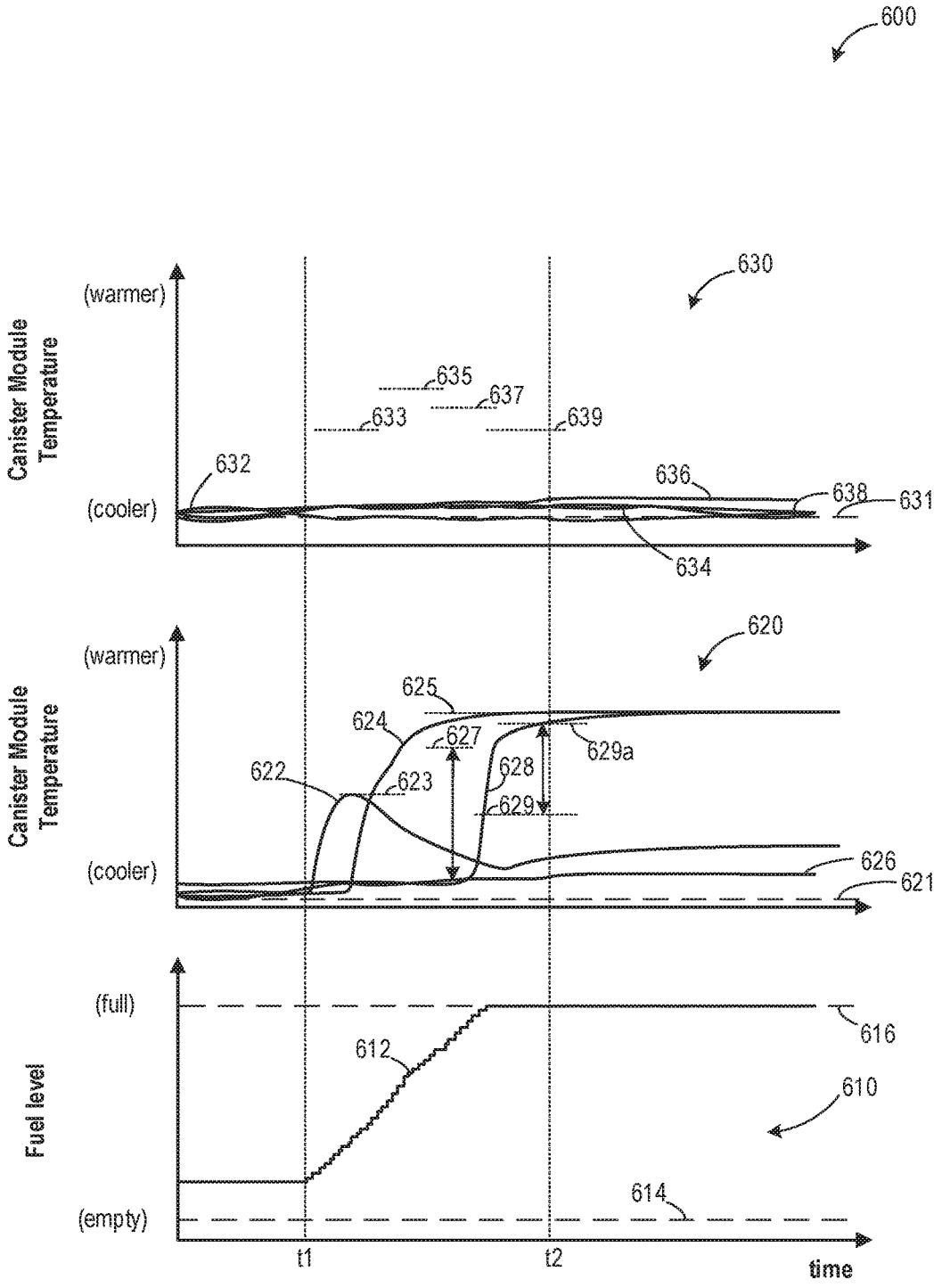
FIG. 6 shows maps of canister module temperature signals during a fueling event executed according to the routines of FIG. 4 and FIG. 5.
Figure 7:
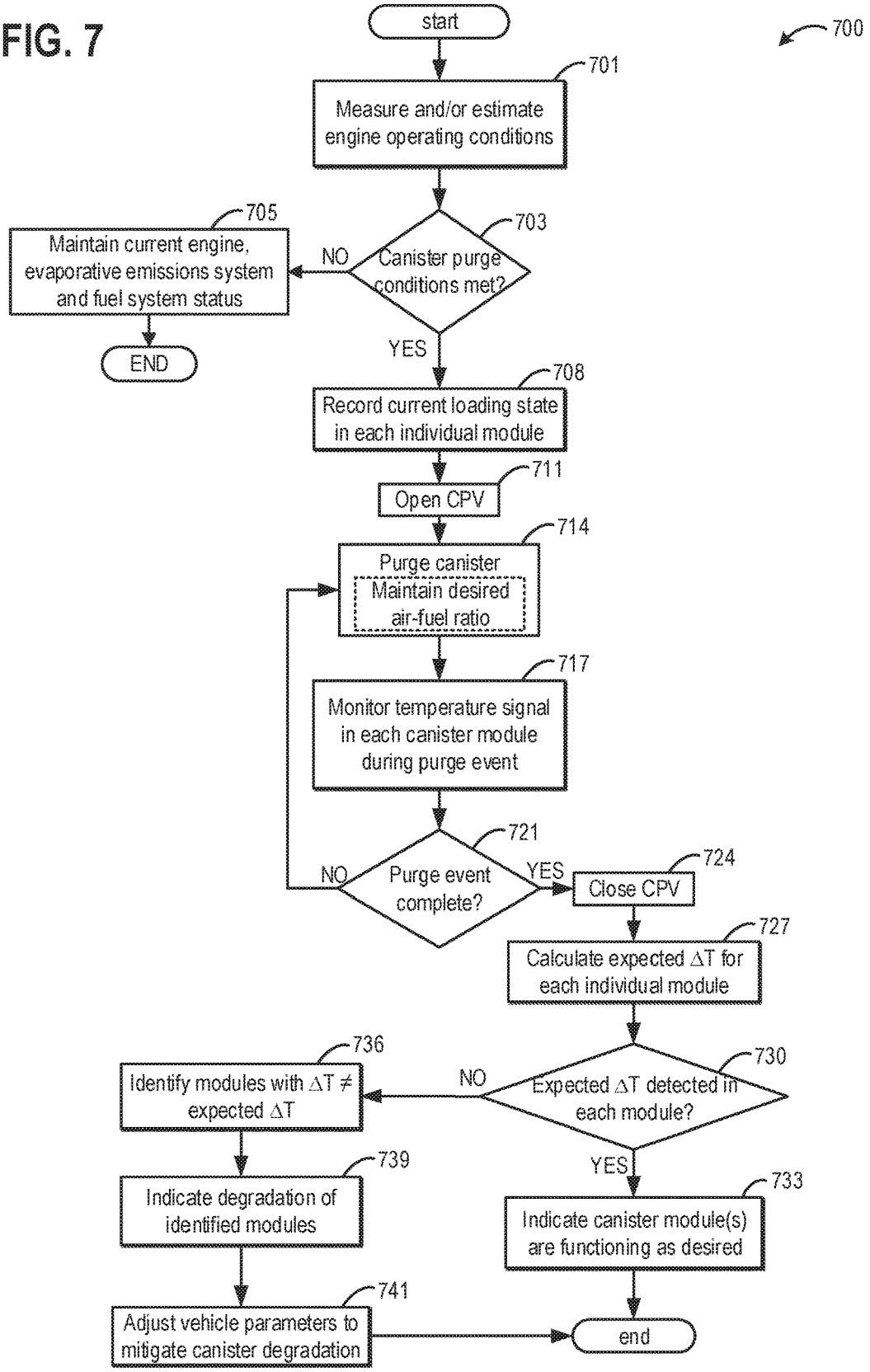
FIG. 7 shows an example routine for diagnosing the functionality of individual canister modules in a modular fuel vapor canister during a purging event.
Figure 8:
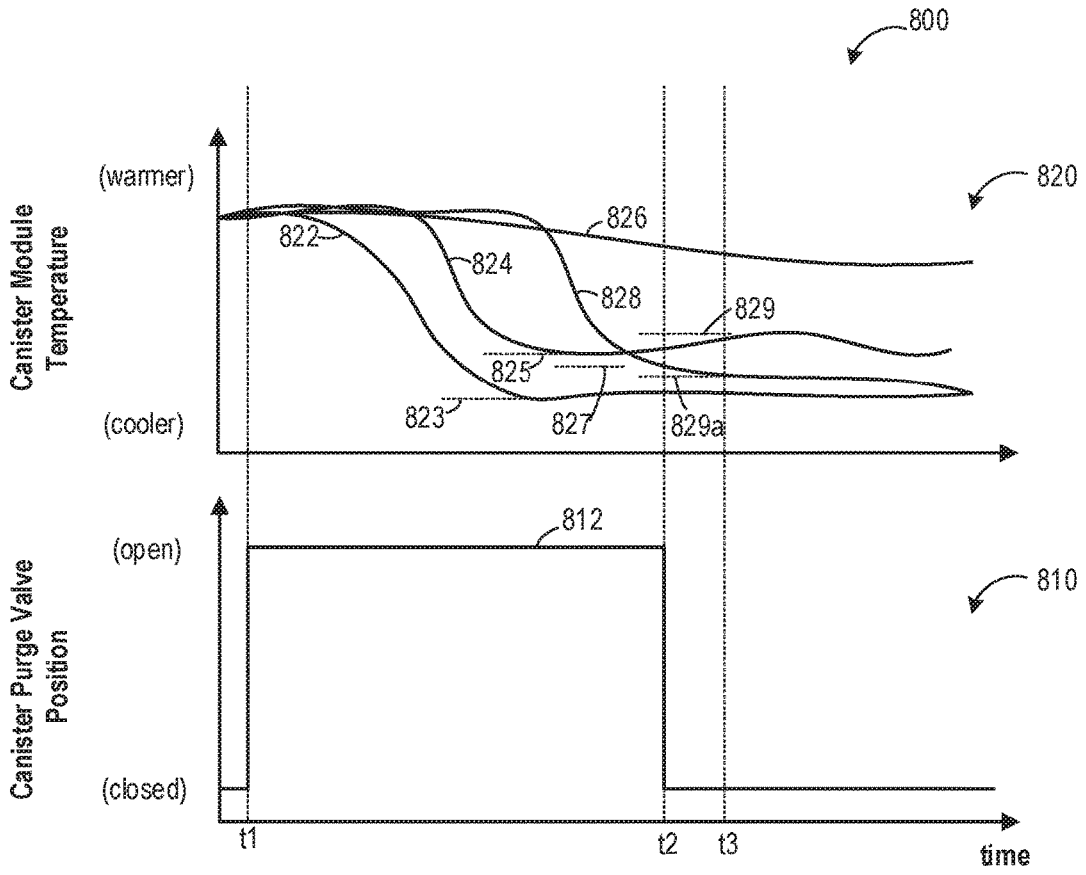
FIG. 8 shows a map of canister module temperature signals during an example purge events executed according to the routine at FIG. 7.

The following description relates to systems and methods for a modular fuel vapor canister. The fuel vapor canister may be part of a fuel system such as that depicted at FIG. 1. The modularity of the fuel vapor canister refers to the canister housing comprising a plurality of canister modules physically coupled together in a sequential arrangement, as shown at FIG. 2. Each canister module includes a temperature sensor for monitoring the temperature therein, and each canister module may be filled with a different adsorbent, allowing for a specific adsorbent configuration to be chosen based on the engine type or regional emissions requirements. The coupling mechanism between each canister module may be one of the coupling mechanisms shown at FIGS. 3A and 3B. The modularity of the fuel vapor canister enables expected temperature changes for each individual canister module to be calculated based on an amount of fuel added to the tank during a refueling event, and further based on an indicated loading state of each individual module prior to adding fuel to the tank, according to the method depicted in FIG. 4. Accordingly, whether individual canister modules are functioning as desired may be indicated subsequent to the refueling event, according to the method depicted in FIG. 5. Example maps depicting the use of temperature sensors to diagnose the functionality of individual canister modules during and subsequent to a completion of a refueling event, according to the methods of FIG. 4 and FIG. 5, are depicted in FIG. 6. In another example, the modularity of the fuel vapor canister enables expected temperature changes for each individual canister module to be calculated based on a duration and aggressiveness of a canister purge event, according to the method depicted in FIG. 7. Accordingly, whether individual canister modules are functioning as desired may be indicated subsequent to the canister purging event. Example maps depicting the use of temperature sensors to diagnose the functionality of individual canister modules during and subsequent to completion of a fuel vapor canister purge event, according to the method of FIG. 7, is depicted in FIG. 8.

Figure 1:
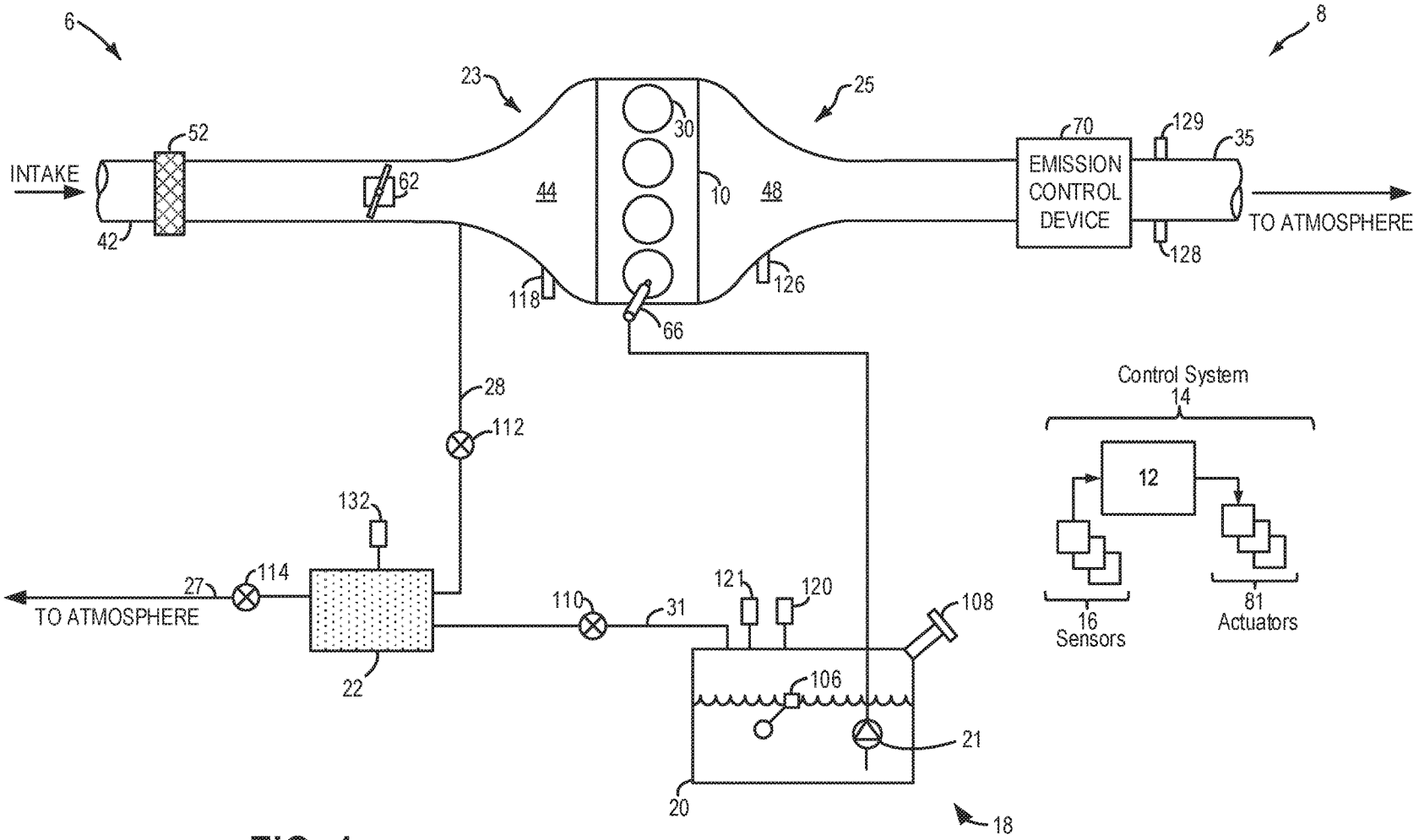
FIG. 1 shows a vehicle system including a fuel vapor canister and a canister purge valve.
Figure 2:
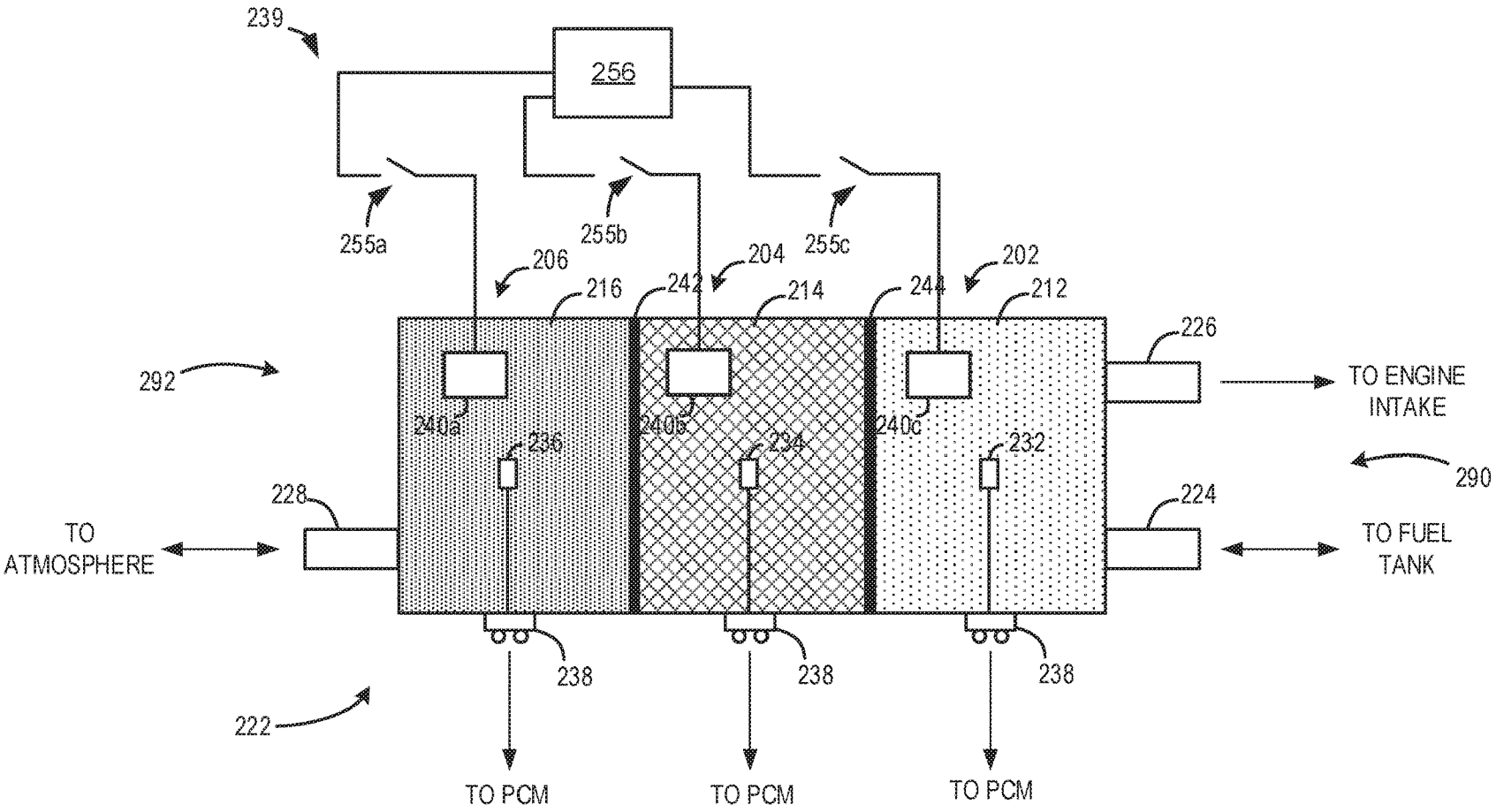
FIG. 2 shows a schematic view of a modular fuel vapor canister including a plurality of sequentially arranged and physically coupled canister modules, a temperature sensor embedded within each of the plurality of canister modules, and a number of different adsorbents filling the plurality of canister modules.

Turning now to FIG. 1, it shows a schematic depiction of a hybrid vehicle system 6 that can derive propulsion power from engine system 8 and/or an on-board energy storage device, such as a battery system (not shown). An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18. Fuel system 18 includes a fuel tank 20 coupled to a fuel pump 21 and a fuel vapor canister 22. During a fuel tank refueling event, fuel may be pumped into the vehicle from an external source through refueling port 108. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening canister purge valve 112. In one example, canister purge valve 112 may be a solenoid valve wherein opening or closing of the valve is performed via actuation of a canister purge solenoid.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 114 may be a solenoid valve wherein opening or closing of the valve is performed via actuation of a canister vent solenoid. In particular, the canister vent valve may be a normally open valve that is closed upon actuation of the canister vent solenoid. In some examples, an air filter may be coupled in vent 27 between canister vent valve 114 and atmosphere.

Canister 22 may comprise a modular configuration. Specifically, canister 22 may comprise a plurality of sequentially arranged canister modules that may be physically and releasably coupled to one another. Canister 22 may include a first end module including a load port and a purge port (e.g., coupling to conduits 31 and 28, respectively), and a second end module including a vent port (e.g., coupling to conduit 27). Canister 22 may further include a plurality of intermediate canister modules coupled therebetween. In this way, the capacity of canister 22 may be adjusted based on emissions standards. The module configuration of fuel vapor canister 22 is described in further detail below, with reference to FIG. 2.

The adsorbent within each canister module may be the same, or alternately the adsorbent may differ between at least two or more modules (e.g., two or more different porosities or adsorption capacities). Thus, loading and unloading of one canister module may not be linear with the loading and unloading of another canister module. Including different adsorbents within the plurality of canister modules is described in further detail below, also with reference to FIG. 2.

Fuel vapor canister 22 may include a temperature sensor 132. Temperature sensor 132 may be embedded within the adsorbent of fuel vapor canister 22 to measure an average temperature within the canister. In one example, temperature sensor 132 may comprise one of a thermistor or a thermocouple. However, other example temperature sensors 132 may be included within fuel vapor canister 22 without departing from the spirit or scope of the present invention.

In the example described above wherein fuel vapor canister 22 includes a modular configuration, a temperature sensor 132 may be provided within each module of the fuel vapor canister, as described below with reference to FIG. 2. In this way, measurements within the fuel vapor canister and operation of the fuel vapor canister may be improved.

Hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, a fuel tank isolation valve 110 may be optionally included in conduit 31 such that fuel tank 20 is coupled to canister 22 via the valve. During regular engine operation, isolation valve 110 may be kept closed to limit the amount of diurnal or "running loss" vapors directed to canister 22 from fuel tank 20. During refueling operations, and selected purging conditions, isolation valve 110 may be temporarily opened, e.g., for a duration, to direct fuel vapors from the fuel tank 20 to canister 22. By opening the valve during purging conditions when the fuel tank pressure is higher than a threshold, the refueling vapors may be released into the canister and the fuel tank pressure may be maintained below pressure limits. While the depicted example shows isolation valve 110 positioned along conduit 31, in alternate embodiments, the isolation valve may be mounted on fuel tank 20. The fuel system may be considered to be sealed when isolation valve 110 is closed. In embodiments where the fuel system does not include isolation valve 110, the fuel system may be considered sealed when purge valve 112 and canister vent valve 114 are both closed.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 directly coupled to fuel tank 20, in alternate embodiments, the pressure sensor may be coupled between the fuel tank and canister 22, for example between the fuel tank and isolation valve 110. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve. In some examples, a vehicle control system may infer and indicate a fuel system leak based on changes in a fuel tank pressure during a leak diagnostic routine.

One or more temperature sensors 121 may also be coupled to fuel system 18 for providing an estimate of a fuel system temperature. In one example, the fuel system temperature is a fuel tank temperature, wherein temperature sensor 121 is a fuel tank temperature sensor coupled to fuel tank 20 for estimating a fuel tank temperature. While the depicted example shows temperature sensor 121 directly coupled to fuel tank 20, in alternate embodiments, the temperature sensor may be coupled between the fuel tank and canister 22.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open isolation valve 110 and canister vent valve 114 while closing canister purge valve (CPV) 112 to direct refueling vapors into canister 22 while preventing fuel vapors from being directed into the intake manifold.

As another example, the fuel system may be operated in a refueling mode (e.g., when fuel tank refueling is requested by a vehicle operator), wherein the controller 12 may open isolation valve 110 and canister vent valve 114, while maintaining canister purge valve 112 closed, to depressurize the fuel tank before allowing enabling fuel to be added therein. As such, isolation valve 110 may be kept open during the refueling operation to allow refueling vapors to be stored in the canister. After refueling is completed, the isolation valve may be closed.

Additionally, during and after refueling, temperature sensor 132 (and any additional temperature sensors of the modular canister configuration described herein) may be utilized to determine degradation of adsorbent within the fuel vapor canister. As a first example, in the modular canister configuration, if a temperature measurement within one module does not increase during a fueling event while surrounding modules do, degradation of said module may be indicated. Diagnosing vapor canister module degradation during a fueling event is described further with reference to FIGS. 5 and 6.

As yet another example, the fuel system may be operated in a canister purging mode (e.g., after an emission control device light-off temperature has been attained and with the engine running), wherein the controller 12 may open canister purge valve 112 and canister vent valve while closing isolation valve 110. Herein, the vacuum generated by the intake manifold of the operating engine may be used to draw fresh air through vent 27 and through fuel vapor canister 22 to purge the stored fuel vapors into intake manifold 44. During such a purge event, temperatures within the vapor canister may decrease due to desorption of fuel vapors from the adsorbent material. In this mode, the purged fuel vapors from the canister are combusted in the engine. The purging may be continued until the stored fuel vapor amount in the canister is below a threshold. As another example, the purging may be continued for a specified duration. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister.

In some examples, the rate of change of temperature within fuel vapor canister 22, or the absolute temperature change may be utilized to estimate a loading state of the fuel vapor canister. For example, the loading state of the fuel vapor canister may be estimated as empty in response to the rate of temperature falling below a threshold rate. For example, controller 12 may end a purge event (e.g., adjust each of canister purge valve 112 and vent valve 114 from open positions to closed positions, and adjust isolation valve 110 from a closed position to an open position) when a temperature measurement falls below a threshold rate of change (e.g. when the temperature signals plateau for a predetermined duration). As will be discussed in further detail below with regard to FIG. 7 and FIG. 8, during and after a purge event, monitored temperature signals may be used to indicate which of the individual canister modules are functioning as desired.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, MAP sensor 118, pressure sensor 120, and pressure sensor 129. Other sensors such as additional pressure, temperature, air/fuel ratio, and composition sensors may be coupled to various locations in the vehicle system 6. For example, ambient temperature and pressure sensors may be coupled to the exterior of the vehicle body. As another example, the actuators may include fuel injector 66, isolation valve 110, purge valve 112, vent valve 114, fuel pump 21, and throttle 62.

Control system 14 may further receive information regarding the location of the vehicle from an on-board global positioning system (GPS). Information received from the GPS may include vehicle speed, vehicle altitude, vehicle position, etc. This information may be used to infer engine operating parameters, such as local barometric pressure. Control system 14 may further be configured to receive information via the internet or other communication networks. Information received from the GPS may be cross-referenced to information available via the internet to determine local weather conditions, local vehicle regulations, etc. Control system 14 may use the internet to obtain updated software modules which may be stored in non-transitory memory.

The control system 14 may include a controller 12. Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

The controller 12 receives signals from the various sensors of FIG. 1 and employs the various actuators of FIG. 1 to adjust engine operation based on the received signals and instructions stored on a memory of the controller. For example, the controller 12 may receive temperature signals from temperature sensor 132 and adjust a duration of a vapor purge event based on the temperature signal. Additionally, controller 12 may utilize the temperature signals from temperature sensor 132 to determine the degradation status of fuel vapor canister 22.

FIG. 2 shows a schematic view of a modular fuel vapor canister 222. As an example, modular fuel vapor canister 222 may be incorporated into a fuel system of a vehicle (e.g., fuel system 18 of vehicle system 6 at FIG. 1). As one example, the walls of modular fuel vapor canister 222 may be manufactured from plastic.

Modular fuel vapor canister 222 includes a purge/load module 202, a vent module 206, and an intermediary module 204. Purge/load module 202 includes load port 224 and purge port 226. Vent module includes vent port 228. It will be appreciated that in other example modular fuel vapor canisters, more than one intermediary module 204 may be disposed between the purge/load module 202 and the vent module 206. In a still further example, a modular fuel vapor canister may include only a purge/load module 202 and a vent module 206.

The modules of canister 222 are arranged in a sequential or series order to form a continuous chamber within the canister walls. That is to say, the sequential arrangement of the canister modules forms the housing of the fuel vapor canister. Each intermediate module 204 may comprise a ring of the same shape and diameter to allow for a fluidic coupling of purge/load module 202 and vent module 206, where escape of fuel vapors from the canister is prevented. Additionally, purge/load module 202 and vent module 206 may be cap-shaped to seal fuel vapor canister 222 from the atmosphere at locations other than ports 224, 226, and 228.

Each module includes a first and second end within the sequential arrangement. The first end of each module may be the end facing first end 290 of canister 222, and the second end may be the end facing second end 292 of canister 222. It will be appreciated that each intermediate module 204 is coupled to two distinct modules at the first and second end of said intermediate module. Additionally, purge/load module 202 includes purge port 224 and load port 226 at the first end, and includes a physical coupling to an intermediate module at its second end. Furthermore, vent module 206 includes a physical coupling to an intermediate module at its first end, and vent port 228 at its second end.

Modular fuel vapor canister 222 may have a cylindrical, rectangular, or cylindrical capsular shape. Because of this, air flow through such canisters may not be uniform. As an example, some canister modules may experience a greater air flow than others. It will be appreciated that module fuel vapor canister 222 may be of a different shape that includes a primary axis of extension (e.g., to accommodate a sequential arrangement of canister modules along said axis) without departing from the spirit and scope of the present invention.

The volumes of the canister modules may all be equal. In other examples, the volumes of the intermediate canister modules 204 may differ from each of purge/load module 202 and vent module 206. As a specific example, each intermediate canister module 204 may be of a greater volume than purge/load module 202 and vent module 206. As another specific example, each intermediate canister module 204 may be of a lesser volume than purge/load module 202 and vent module 206. In one example, the volume of each intermediate canister module 204 is identical, however in other examples, modular canister 222 may comprise intermediate canister modules of a plurality of volumes. In a preferred embodiment, the volumes of each intermediate canister module 204 are identical, said volume differing from the volumes of each of purge/load module 202 and vent module 206. In this way, modular fuel vapor canister 222 may be configured to be of a desired volume based on one or more of engine size, fuel type, local emissions requirements, fuel tank capacity, engine and powertrain type, and packaging space available within the engine compartment.

The modules of fuel vapor canister 222 may be releasably physically coupled. Specifically, each module may include coupling mechanisms. Each intermediate module may include coupling mechanisms on each end of the module (e.g., at each end adjacent to another canister module). Purge/load module 202 and vent module 206 may include coupling mechanisms on the end of the module that does not include ports. The physical couplings the modules of fuel vapor canister 222 are described in further detail with reference to FIGS. 3A and 3B.

Seals 242 and 244 may be provided to ensure air-tight couplings between each canister module, thereby reducing inadvertent vapor leakage from the canister. In one example, each seal is a rubber O-ring. As shown, fuel vapor canister 222 includes two seals, however it will be understood that the number of seals will be one less than the number of canister modules that compose fuel vapor canister 222.

Load port 224 may be configured to accept fuel vapor from the fuel tank via a first conduit positioned therebetween (e.g., via conduit 31 at FIG. 1). The flow of fuel vapor through load port 224 and into fuel vapor canister 222 may be at least partially controlled by the position of a flow control valve situated on said conduit (e.g., isolation valve 110 at FIG. 1). As such, the load port (e.g. first port) may be selectively coupled to the fuel tank. Purge port 226 is configured to release fuel vapors from vapor canister 222 to an intake manifold via a second conduit (e.g., conduit 28 at FIG. 1). The flow of fuel vapor through purge port 226 may be at least partially controlled by a flow control valve situated on said second conduit (e.g., canister purge valve 112 at FIG. 1). As such, the purge port (e.g. second port) may be selectively fluidly coupled to the intake manifold. Vent port 228 is configured to accept fresh air from the atmosphere via a third conduit (e.g., vent 27 at FIG. 1). The flow of air from the third conduit and into fuel vapor canister 222 may be at least partially controlled via a flow control valve situated on the third conduit (e.g., canister vent valve 114 at FIG. 1). As such, the vent port (e.g. third port) may be selectively fluidly coupled to atmosphere. The introduction of air into the fuel vapor canister may displace or desorb fuel vapors from one or more of adsorbents 216, 214, and 212 within fuel vapor canister 222.

Each canister module may be filled with an adsorbent for capturing fuel vapors introduced to canister 222 via load port 224. In other words each individual module may house adsorbent material for capturing and storing fuel vapors from the vehicle fuel tank, and the adsorbent material within each individual module can differ between the individual modules. As one example, each adsorbent is a form of activated carbon. As an example, each canister is filled with an activated carbon of a different adsorption capacity. For example, adsorbent 212 within purge/load canister module 202 may have a first adsorption capacity, adsorbent 214 within intermediate canister module 204 may have a second adsorption capacity, and adsorbent 216 within vent canister module 206 may have a third capacity. As another example, each of adsorbents 212, 214, and 216 may be the same type of adsorbent with a similar adsorption capacity.

As used herein, the term "adsorption capacity" may refer to the fuel vapor retention capacity of an adsorbent. It will be appreciated that an adsorbent with a greater adsorption capacity refers to a given volume of said adsorbent holding a larger mass of fuel vapor per unit volume of adsorbent, and vice versa. As one example, adsorbent with a higher adsorption capacity may have a higher density of pores within the activated carbon.

The sequential arrangement of adsorbent types (herein also termed "adsorbent configuration") within fuel vapor canister modules 222 may be configured to reduce vehicle emissions.

As a first example adsorbent configuration, adsorbent 212 may be an adsorbent of a higher adsorption capacity, adsorbent 214 may be an adsorbent of an intermediate adsorption capacity, and adsorbent 216 may be of a lower adsorption capacity. More generally, the first example adsorbent configuration may include the adsorption capacities arranged in a sequentially increasing order from the vent module 206 toward the purge/load module 202. That is to say, adsorbent 216 has the lowest adsorption capacity within canister 222, adsorbent 212 has the highest adsorption capacity within canister 222, and if fuel vapor canister 222 includes more than one intermediate module, the adsorption capacity of the adsorbent within each module monotonically increases from the intermediate module adjacent to vent module 206 toward the module adjacent to purge/load module 202.

An advantage of including a higher-capacity adsorbent at the purge/load module is to allow for increased adsorption where fuel vapor enters the canister 222. Additionally, by including the higher-capacity adsorbent in only the purge/load module, adsorbent costs may be reduced as compared to filling each module of canister 222 with higher-capacity adsorbent. By including a lower capacity adsorbent near the vent port, the rate of fuel vapor desorption near the vent port may be increased during purge events. By increasing the potential for fuel vapor desorption near the vent port, bleed emissions may be reduced.

As a second example adsorbent configuration, adsorbent 212 and adsorbent 214 may each be a high-capacity adsorbent, and adsorbent 216 may be of a monolithic structure. The monolithic adsorbent may include a plurality of restrictive flow paths therein, and the material from which it is constructed may be of a high adsorption capacity. The monolithic adsorbent may occupy the entire volume of the canister module. In this way, when the vehicle is inactive, flow of fuel vapor from the vapor canister to the atmosphere via vent port 228 may be reduced. Put another way, hydrocarbon diffusion during diurnal conditions (e.g., bleed emission) may be reduced.

Still other adsorbent configurations may be utilized without departing from the spirit and scope of the present invention. An advantage of the modular adsorbent configuration is to improve adherence to emission regulations while still selecting a configuration based on the vehicle powertrain. A still further advantage of the modular adsorbent configuration is reduced manufacturing costs. As one example of the still further advantage, a common canister construction may be utilized for a plurality of adsorption configurations, thereby reducing costs associated with manufacturing a canister design based on a desired adsorbent configuration. As another example of the still further advantage, by including a modular adsorbent configuration within fuel vapor canister 222, costs may be reduced when compared to using the same adsorbent throughout the canister.

Vapor canister modules 202, 204, and 206 may include respective temperature sensors 232, 234, and 236 embedded therein. In an example canister with a plurality of intermediate modules 204, a temperature sensor 234 is embedded within each intermediate module. In one example, a sensing portion of the sensor may be embedded within the adsorbent of the canister module, and the may be electrically coupled to a vehicle control system via an electrical pin 238 positioned outside of the walls of the canister module, the electrical pin configured to transmit data from the temperature sensors to the vehicle controller (e.g., 12), or powertrain control module (PCM). By including temperature sensors in each canister module, the detail/resolution of temperature data throughout the vapor canister may be improved. Additionally, maintenance of the temperature sensors may be improved. Specifically, if a temperature sensor is degraded, only one module and temperature sensor of the vapor canister 222 may be replaced, as opposed to replacing the entirety of a vapor canister sensor system or replacing the entire canister.

An engine controller (e.g., controller 12 at FIG. 1) may include information regarding the relative positioning of each canister module within vapor canister 222. The controller may further include information regarding the type of adsorbent with which each module is filled. Thus a controller may utilize signals from temperature sensors 232, 234, and 236 to indicate a loading state of each individual module, and to indicate potential modules that are not functioning as desired during refueling and/or purging events, as described in detail below.

Still other configurations of canister modules may be utilized without departing from the spirit and scope of the present invention. For example, any different number of intermediate canister modules may be utilized in fuel vapor canister 222. As another example, any number of different adsorbent arrangements may be utilized in fuel vapor canister 222.

In some examples, canister 222 may be coupled to a canister temperature management system 239. Canister temperature management system 239 may include one or more heating and one or more cooling mechanisms. For example, canister temperature management system 239 may include one or more thermo-electric devices (e.g., heating elements or cooling elements). In this example, Peltier elements 240*a*, 240*b*, 240*c* are coupled within the central cavity of each individual canister module, and may be operable to selectively heat or cool the canister adsorbent bed. Each Peltier element has two sides. For clarity, only the side internal to the canister is shown in FIG. 2. When DC current flows through a Peltier element, it brings heat from a first side to a second, opposite side. In a first conformation, heat may be drawn from the side on the interior of the canister towards the exterior side, thus cooling the interior of the canister. Alternatively, if the charge polarity of the Peltier element is reversed, the thermoelectric generator may operate in the other direction, drawing heat from the exterior of the canister, thus warming the interior of the canister. DC current may be provided by a rechargeable battery 256. One or more switches 255*a*, 255*b*, 255*c* under control of the controller or PCM (e.g., 12) may regulate the flow of current to Peltier elements 240*a*, 240*b*, 240*c*. As such, it may be understood that each individual Peltier element may be differentially regulated in order to selectively heat or cool each individual canister module, as described in further detail below.

Furthermore, while not explicitly shown in FIG. 2, it may be understood that there may be ports between each fuel vapor canister module, for example at the position indicated by seals 242 and 244, which fluidically couple one canister module to the other. For example, as fuel vapors may travel from the fuel tank through the modular canister to toward atmosphere, each module must comprise ports to enable the vapors to flow readily though the entirety of the modular canister. Similarly, during purge events, fresh air may be drawn into the fuel vapor canister, and such fresh air needs to be drawn through the entirety of the modular fuel vapor canister. Accordingly, it may be understood that each individual modular canister is fluidically coupled to one another. For example, the "port" between two modules may be nearly the diameter of the individual modules, such that maximum air/vapor flow may be permitted to flow between individual canister modules. In other examples, the ports may be arranged to encourage a desired air flow. For example, the ports may be arranged such that air/vapor flow is encouraged to come into contact with all areas of the fuel vapor canister modules, for example a "spiral" flow such that all areas of the individual modules may be loaded/purged to the same degree. By designing the individual modules to encourage specific air flow paths between canister modules, the adsorption/desorption properties of the modular fuel vapor canister may be improved.

In some examples, an advantage of having one or more temperature sensor(s) in each individual module may include an ability to selectively clean individual canister modules, based on operating conditions, or potentially based on future operating conditions. For example, if the vehicle will be stored outside in a warm/hot climate for a prolonged time period, where bleed emissions from the canister may occur if the fuel vapor canister is loaded, a selective purge event may be conducted wherein only the canister module or modules closest to the vent line may be purged, such that bleed emissions may be reduced. In another example, responsive to an indication of an imminent refueling event, the canister module or modules closest to the purge/load side of the canister may be selectively purged prior to the refueling event. In both examples, temperature sensors imbedded within each module may enable precise cleaning of individual modules. Furthermore, in some examples the Peltier elements may be selectively heated or cooled, to encourage fuel vapor desorption, or adsorption, respectively. For example, in a case where one or more modules are to be selectively cleaned, selectively heating said modules via Peltier elements positioned within said modules may encourage efficient desorption of the fuel vapors from the select modules. Alternatively, in a case where one or more modules are expected to adsorb refueling vapors, the select modules may be selectively cooled in order to increase the efficiency of adsorption, for example.

Figure 3B:
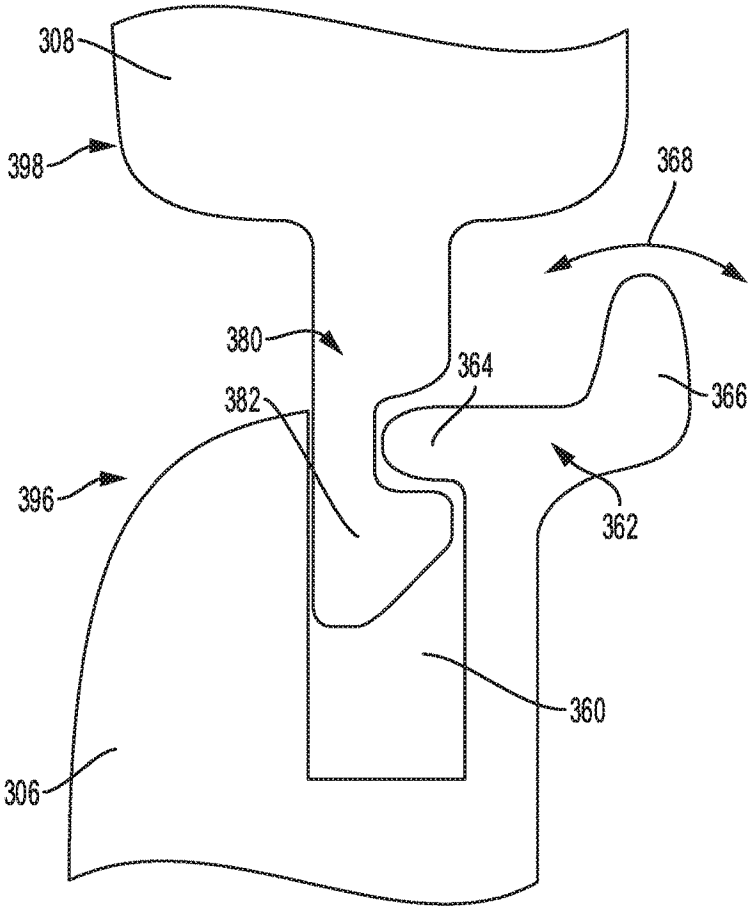
FIG. 3B shows a second example coupling mechanism for a canister module.
Figure 3A:
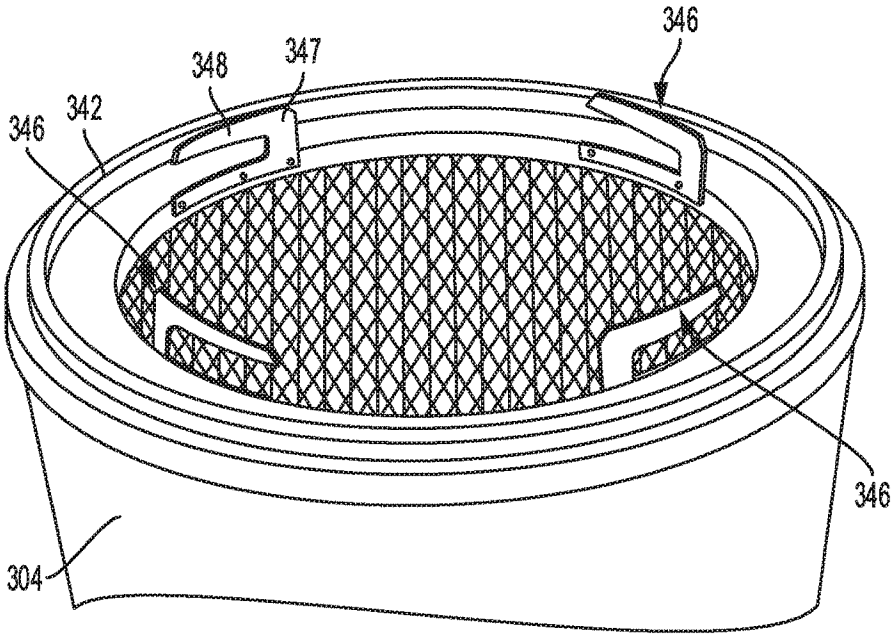
FIG. 3A shows a first example coupling mechanism for a canister module.

FIGS. 3A and 3B show example coupling mechanisms which may be included on each canister module. Specifically, FIG. 3A shows a canister module 304 including a first coupling mechanism, while FIG. 3B shows a schematic view of a second coupling mechanism which may be included with canister module 306 in other example vapor canisters. It will be understood that the plurality of modules which compose a single fuel vapor canister will all include either the first or the second coupling mechanism. That is to say, no module will include each of the first and second coupling mechanisms, and all of the modules composing the vapor canister will include the same coupling mechanism.

It will be understood that each intermediate module (e.g., 204 at FIG. 2) includes a coupling mechanism on each end of the module, and the vent module (e.g., 206 at FIG. 2) and the purge/load module (e.g., 202 at FIG. 2) include coupling mechanisms only on the end of the module that couples to an intermediate module, and not on the end of the module that includes port(s). In this way, a fuel vapor canister may comprise a plurality of sequentially arranged and physically releasably coupled canister modules.

Turning now to FIG. 3A, the first coupling mechanism includes a rotatable locking mechanism. Specifically, each canister module is configured with a plurality of locking arms 346 which are configured to receive a plurality of locking arms of another canister module. The locking arms 346 include a base portion 347 extending along the axis of extension of the canister, and an arm portion 348 extending angularly from a distal end of the base portion. When physically coupled, each base portion may be in physical contact. Two coupled canister modules may be uncoupled by rotating a first module in a counterclockwise direction and maintaining the second module in a fixed position.

Canister module 304 is also shown with a seal 344. Seal 344 may be similar to seals 242 and 244 described at FIG. 2. In one example, only one seal may be included per connection between two modules.

FIG. 3B shows a second coupling mechanism, which includes a snap-fit. The mechanism of FIG. 3B may be included on vapor canister module 304 of FIG. 3A in place of locking arms 346. A first end 396 of a first module 306 may be coupled to a second end 398 of a second module 308 via the snap-fit. It will be understood that each intermediate module (e.g., 204 at FIG. 2) may include an accepting mechanism on a first end, and a protrusion on the second end. It will be appreciated that one of the purge/load module and the vent module may include ports on one end, and a protrusion on another end, while the other may include an accepting mechanism on one end, and port(s) on the other end.

The first end 396 includes a cavity 360 formed from the space between the main body of the module and an accepting mechanism 362. Accepting mechanism 362 includes a knob 364 on the face adjacent to cavity 360 and includes a pliable tab 366 on the opposite face. The knob is configured to secure the position of a protruding portion 380 on the second end of the second module when the first and second modules are coupled, as explained below. The pliable tab of the accepting mechanism is movable in the direction indicated by arrow 368. In this way, pliable tab 366 may be moved in a first direction to increase the size of cavity 360 in order to accept a protruding portion 380 of the second end 398 of the second module, and moved in a second direction to decrease the size of cavity 360, thereby holding the protruding portion in place.

A second end 398 of second module 308 includes a protruding portion 380. Protruding portion 380 includes a hooked end 382 which may be inserted into cavity 360 and secured by accepting mechanism 362. A physical coupling of first module 306 and second module 308 may be achieved by inserting protruding portion 380 into cavity 360. A decoupling of first module 306 and second module 308 may be achieved by moving pliable tab 366 away from protruding portion 380 to increase the size of cavity 360, and removing protruding portion 380 from cavity 360.

Each of the coupling mechanisms described above may securely couple a first and second canister module, and may also be configured to be uncoupled when maintenance of the canister is desired. In this way, maintenance of the canister may be facilitated via a faster uncoupling of modules.

As described above with reference to FIG. 2, each module in the modular fuel vapor canister design may include a different adsorbent, and each module is positioned at a different location between the vent module and the purge/load module. When processing temperature signals from a plurality of temperature sensors within a fuel vapor canister (e.g., temperature sensors 232, 234, and 236 at FIG. 2), different temperature thresholds may indicate different conditions based on the position of the module within the canister and the adsorbent with which the module is filled.

For example, a first adsorbent at a specified position within the canister may be considered to be in a completely loaded state when a temperature signal is at or above a threshold temperature, while a second adsorbent at the same position may be considered to be only partially loaded when the temperature signal is at the same temperature. Furthermore, expected temperature rises in each individual module may be further based on an amount of fuel added to the fuel tank during a refueling event, where the expected temperature rises take into account the loading state of individual modules prior to commencing a refueling event.

Turning now to FIG. 4, a flow chart for a high level example method is shown for generating expected temperature profiles for each module of a modular fuel vapor canister for a refueling event. More specifically, method 400 may be used to record a fuel level in the fuel tank at the start of a refueling event, and record a loading state in each individual module of the modular fuel vapor canister. Based on the loading state of each individual module of the modular fuel vapor canister, temperature thresholds for indicating when each individual module are saturated may be generated. Furthermore, based on the amount of fuel added to the fuel tank, an expected temperature rise profile for each module may be indicated, such that diagnosis of the working capacity of each individual module may be assessed. Method 400 may be carried out by a controller, such as controller 12 in FIG. 1, and may be stored at the controller as executable instructions in non-transitory memory. Instructions for carrying out method 400 and the rest of the methods included herein may be executed by the controller based on instructions stored on a memory of the controller and in conjunction with signals received from sensors of the engine system, such as the sensors described above with reference to FIG. 1 and FIG. 2. The controller may employ fuel system and evaporative emissions system actuators, such as fuel tank isolation valve (e.g., 110), canister vent valve (e.g., 114), canister purge valve (e.g., 112) etc., according to the method below.

Method 400 begins at 402 and may include recording a fuel level in a fuel tank at the start of a refueling event. For example, initiation of a refueling event may comprise a vehicle operator depressing a refueling button on a vehicle instrument panel in the vehicle, or at a refueling door of the vehicle. In some examples, the start of a refueling event may comprise a refueling operator requesting access to a fuel filler neck, for example, by attempting to open a refueling door, and/or attempting to remove a gas cap. At the time of a start of a refueling event, fuel level may be indicated, for example by a fuel level sensor (e.g., 106). In some examples, the fuel level may be stored at the controller (e.g., 12). By storing the fuel level at the start of the fuel event, an accurate indication of the amount of fuel added to the fuel tank during the refueling event may be thus determined, as discussed in further detail below.

Proceeding to 404, method 400 may include recording the current loading state of each canister module. For example, as discussed above, each canister module may comprise a different adsorbent, with differing adsorbent capacities. Furthermore, loading state may vary between individual modules based on the position of modules within the modular fuel vapor canister. Accordingly, in order to accurately assess the functionality of each individual module subsequent to a refueling event, the loading state of each individual module may need to be determined prior to the start of the refueling event. As such, a loading state of each individual canister module may be recorded at 404, prior to the addition of fuel to the tank. As described above, a loading state of each individual canister module may be indicated based on temperature sensors imbedded in each individual canister module. In some examples, the loading state of each individual canister module may be stored at the controller (e.g., 12). By storing the loading state of each individual canister module prior to the addition of fuel to the tank, expected temperature thresholds may be set and updated loading states may be determined subsequent to the refueling event, as discussed in further detail below.

Accordingly, continuing to 406, method 400 includes adjusting temperature thresholds based on the indicated current loading states of each individual canister module. For example, if one canister module is indicated to be clean (e.g., free of hydrocarbons), then an indication that that canister module has become saturated may comprise a temperature change of a first amount, if the canister module is functioning as desired. As such, the temperature threshold for that one canister module may comprise a temperature change of the first amount. However, in another example, the same one canister module may be indicated to be fifty percent loaded. Accordingly, an indication that that canister module has become saturated may comprise a temperature change of another (second) amount. In this example, the temperature change threshold may comprise about half of the temperature change that would be expected if the individual canister module were free of hydrocarbons. Still further, adjusting temperature thresholds based on current loading state(s) of each individual module may include taking into account the makeup and capacity of the adsorbent within each individual module. For example, consider a canister module that is clean and contains an adsorbent with low adsorbing capabilities. In such an example, a relatively small temperature change may indicate a saturated canister module. Alternatively, consider another canister module that is also clean, but which contains an adsorbent with very high adsorbing capabilities. In such an example, a relatively large temperature change may indicate a saturated canister module. Accordingly, at 406 of method 400, temperature thresholds for indicating when each individual canister module is saturated may be set based on the current loading state of each individual canister module as obtained at 404 of method 400, and may further include taking into account the adsorbent makeup and adsorbent capacities. Such information on the adsorbent makeup and adsorbent capacities for each individual canister module may be stored at the controller in a lookup table, in some examples. Furthermore, adjusted temperature thresholds generated at 406 prior to the addition of fuel to the tank may be stored at the controller (e.g., 12).

Subsequent to recording fuel level, recording current loading state of each individual canister module, and adjusting temperature thresholds of each individual canister module based on canister loading state and adsorbent capacities, refueling may commence. Refueling may include commanding open a fuel tank isolation valve, maintaining closed a canister purge valve, and commanding open or maintaining open a canister vent valve. As such, proceeding to 408, method 400 may include indicating the fuel amount added to the fuel tank during the refueling event. Such an indication may be based on the fuel level sensor subsequent to completion of the refueling event, as compared to the fuel level indicated at the start of the refueling event, prior to the addition of fuel to the tank. As such, an accurate indication of how much fuel was added to the tank may be attained.

Proceeding to 410, method 400 may include generating an expected temperature rise profile for each module based on the fuel amount added to the tank, taking into account the information obtained on canister loading state and the adjusted temperature thresholds, as discussed above. For example, a defined amount of fuel vapors may be generated responsive to a defined amount of fuel added to the fuel tank. Such vapors may be further adsorbed by a defined amount of adsorbent. For example, consider a small amount of fuel added to the tank. If a first canister module is indicated to be free of hydrocarbons, then the amount of fuel vapors may be readily adsorbed by the first canister module. In such an example, an expected temperature rise in the first module may be indicated based on the amount of fuel added to the tank, and may be correlated with canister loading state. In another example, consider a first canister module that is nearly saturated with fuel vapor. If a fuel tank is nearly empty and is filled to capacity, a defined amount of fuel vapors may be generated responsive to the amount of fuel added to the tank. Such an amount of fuel vapors may not be capable of being adsorbed by the first canister module. Instead, an expected temperature rise profile may be generated for the first canister module, which may include the temperature expected to reach the adjusted temperature threshold (determined at 406), indicating saturation. Based on this information, in similar fashion it may be determined how much of the fuel vapor may be adsorbed by a second canister module, depending on the loading state of the second canister module, and the fuel amount added to the tank, but where the amount of fuel vapors left to be adsorbed may be adjusted to account for the amount of fuel vapors adsorbed by the first fuel vapor canister. In this example, it may be determined that based on the amount of fuel added to the tank (minus fuel vapors adsorbed by the first canister module), in addition to the capacity and loading state of the second canister, an expected temperature rise in the second canister module corresponds to a saturation of the second canister module. Accordingly, in similar fashion it may be determined how much of the remaining fuel vapor may be adsorbed by a third fuel vapor canister module, and so on. In this way, for each refueling event, expected temperature profiles for each canister module may be indicated based on the level of fuel added to the tank, and if there is a discrepancy between the expected and actual temperature profiles then one or more of the canister modules may be indicated to not be functioning as desired, as will be discussed in more detail below. Briefly, if it is predicted that a given refueling event will saturate three of the individual canister modules, while loading a fourth canister module by fifty percent, if the first two canister modules are indicated to have become saturated based on expected and measured temperature profiles, yet the third canister module does not change as expected, and instead the fourth module is indicated to have become saturated, a problem with the third canister module may be indicated. In other words, based on the expected temperature profiles, which are in turn a function of individual canister module adsorbent capacity, and loading state prior to refueling, functionality of the individual canister modules may be indicated, discussed in further detail below.

While the above-described methodology was discussed in relation to a modular fuel vapor canister, it may be understood that a similar methodology may be used to indicate whether a typical fuel vapor canister that is not modular is functioning as desired. For example, in a typical canister that is not modular, a single temperature sensor may be positioned near the canister vent line (e.g., 27). Prior to a refueling event, a canister loading state may be indicated, and a fuel level in the tank may be indicated. Based on the canister loading state, and the level of fuel added to the tank, and expected temperature rise profile may be indicated. For example, in some cases a temperature rise as indicated by the temperature sensor placed near the vent line (e.g., 27) would not be expected based on the canister loading state prior to refueling and the amount of fuel added to the tank. In such an example, if a temperature rise is indicated, then it may be determined that the canister is not functioning as desired. Similarly, more than one canister temperature sensor may be included in such an example, where a temperature rise profile may be indicated for each temperature sensor based on canister loading state prior to refueling, and the amount of fuel added to the tank. As such, the example methodology described herein as related to modular fuel vapor canisters may additionally apply to conventional non-modular canisters, without departing from the scope of the present disclosure.

Turning now to FIG. 5, a flow chart for a high level example method 500 for diagnosing whether any number of individual canister modules in a modular fuel vapor canister are functioning as desired, is shown. More specifically, responsive to a refueling event, expected temperature profiles for each individual canister may be generated according to the method depicted in FIG. 4, and based on the indicated temperature changes in the individual modules, functionality of the individual canister modules may be determined according to method 500. In other words, method 500 includes adsorbing fuel vapors in a plurality of individual vapor storage modules connected together in series, the individual vapor storage modules comprising a modular fuel vapor canister which is coupled to a fuel tank; and evaluating performance of each the individual modules responsive to a monitored temperature change being different than an expected temperature change in the individual modules during the adsorption of fuel vapors. Method 500 may be carried out by a controller, such as controller 12 in FIG. 1, and may be stored at the controller as executable instructions in non-transitory memory. Instructions for carrying out method 500 and the rest of the methods included herein may be executed by the controller based on instructions stored on a memory of the controller and in conjunction with signals received from sensors of the engine system, such as the sensors described above with reference to FIG. 1 and FIG. 2. The controller may employ fuel system and evaporative emissions system actuators, such as fuel tank isolation valve (e.g., 110), canister vent valve (e.g., 114), canister purge valve (e.g., 112), etc., according to the method below.

Method 500 begins at 502 and includes commencing a refueling event. As discussed above with regard to FIG. 4, prior to commencing the refueling event, fuel level in the tank may be indicated, current loading state(s) of each individual module may be indicated, and temperature thresholds for indicating saturation of each individual module may be indicated. Furthermore, as described above with reference to vehicle system 6 and fuel system 18 at FIG. 1, the fuel system may be operated in a refueling mode (e.g., when fuel tank refueling is requested by a vehicle operator), wherein the controller 12 may open a fuel tank isolation valve (e.g., 110) and a canister vent valve (e.g., 114), while maintaining a canister purge valve (e.g., 112 closed), to depressurize the fuel tank before enabling fuel to be added therein. As such, fuel tank isolation valve may be kept open during the refueling operation to allow refueling vapors to be stored in the canister. Accordingly, at 502, method 500 includes beginning the addition of fuel to the fuel tank. Upon addition of fuel to the tank, an increase in fuel level may be indicated via a fuel level sensor (e.g., 106).

Proceeding to 504, while the refueling event is in progress, method 500 may include monitoring fuel level in the tank and monitoring temperature signals in each canister module. For example, an engine controller may track temperature signals for each canister module via temperature sensors (e.g., 232, 234, 236) embedded in each individual module throughout a duration of the fueling event and may process the temperature signals after the fueling event has ended. Additionally, the fuel level within the fuel tank may be monitored as described above.

Proceeding to 506, method 500 may include indicating the end of the refueling event. For example, completion of refueling at 506 may be indicated when the indicated fuel level has plateaued for a predetermined duration of time. In another example, indicating the end of the refueling event may further include an indication that a refueling nozzle has been removed from the fuel filler neck, that a fuel cap has been replaced, that a refueling door has been closed, etc.

As discussed above, responsive to the end of the refueling event, the temperatures signals that were monitored during the course of the refueling event may be processed. For example, according to method 400, subsequent to completion of the refueling event, an expected temperature rise profile for each module may be generated and may be based on the loading state of each individual module prior to commencing refueling, the adsorbent capacity of each individual module, and the total amount of fuel added to the tank during the refueling event. With the expected temperature rise profile for each module generated, the temperature signals acquired from each module during refueling may be processed and compared to the expected temperature rise profiles. Deviations from the expected temperature rise profiles may indicate one or more canister modules are not functioning as desired, as described in further detail below. Processing of such signals may be conducted by the controller (e.g., 12), based on inputs from the individual temperature sensors in each module, and input from the fuel level sensor.

Continuing to 508, method 500 includes indicating whether indicated temperature change(s) corresponds to the expected temperature rise profile(s) generated for each module, in at least one module. If none of the measured temperature changes in the individual modules corresponds to the expected temperature rise profiles, method 500 may proceed to 510 and may include indicating a general degradation of the canister. In some examples, the amount of fuel added to the tank may be small, and as such certain modules may not be expected to experience temperature change, for example those canister modules positioned close to the canister vent line (e.g., 27). However, because none of the canister modules that were expected to experience a temperature rise based on the amount of fuel added to the tank actually did experience a corresponding temperature rise, then general degradation of the canister may be indicated. Such a condition may occur responsive to a substantial volume of fuel or water entering the canister and corrupting the activated carbon, for example. Other examples of general degradation of the fuel vapor canister may comprise an aging of the canister to the point where no module in the canister is capable of adsorbing fuel vapor. In still other examples, general degradation of the fuel vapor canister may include degradation of each temperature sensor, faults in electrical connections from the temperature sensors to the controller, vapor escaping from the canister prior to being adsorbed in the individual canister modules, clogged ports, internal restrictions, etc. As such, at 510, indicating general degradation of the fuel vapor canister may include setting a diagnostic trouble code and activating a malfunction indicator light (MIL), in order to alert the vehicle operator of the need to replace the canister. Furthermore, continuing to 511, method 500 may include adjusting vehicle parameters to mitigate canister degradation. In some examples, adjusting vehicle parameters may include operating the vehicle propulsion system in an electric only mode as frequently as possible in order to reduce the amount of fuel consumed by the engine, thus resulting in less potential refueling events. In another example, a fuel tank isolation valve may be controlled to reduce the amount of fuel vapors traveling from the fuel tank to the fuel vapor canister. In similar fashion a canister vent valve may be controlled to reduce the amount of fuel vapors traveling from the fuel tank to the fuel vapor canister. In still other examples, pressure in the fuel tank may be monitored (in a case where the fuel tank isolation valve is maintained closed) during engine operating conditions, and responsive to fuel tank pressure above a threshold, the fuel tank isolation valve, canister vent valve, and canister purge valve, may be commanded open, and fuel vapors from the fuel tank may be purged directly to engine intake, without being first adsorbed by the fuel vapor canister. In such an example, rather than directing fuel vapors to the canister, fuel vapors from the tank may be directly routed to engine intake, thus mitigating the effects of canister degradation.

In still another examples, if no modules are indicated to experience the expected temperature change, there may be a problem inherent with the temperature sensors. In such an example, a follow-up test may be conducted. For example, Peltier elements (e.g., 240*a*, 240*b*, 240*c*), may be activated in order to generate a specified amount of heat (or cooling effect) in each individual canister module. With the Peltier elements activated, the functionality of the temperature sensors may be conducted. For example, if one or more temperature sensors in the individual modules indicate a temperature change responsive to activation of the one or more Peltier elements, then it may be concluded that the temperature sensors are functioning as desired, but the individual canister modules (e.g., the adsorbent within), are not functioning as desired. In such an example, modules that are concluded to be generally degraded may be flagged for service, as discussed above. However, if during activation of the Peltier elements to rationalize the temperature sensors, one or more temperature sensors fail to respond to the increased heat (or cooling), then it may be determined that the one or more temperature sensors are not functioning as desired. As such, by selectively activating the Peltier elements and monitoring for a temperature increase/decrease in each individual canister module, further diagnoses may be conducted responsive to an indication of no measured temperature changes matching expected temperature changes during a refueling event.

Returning to 508, if it is indicated that the indicated temperature change(s) in at least one module corresponds to the expected temperature rise profile(s) in the at least one module, then method 500 may proceed to 512. At 512, method 500 may include indicating whether the indicated temperature changes in the modules predicted to experience temperature change during the refueling event correspond to the expected temperature change in each said module. If the indicated temperature changes in each module correspond to the expected temperature change in each module, method 500 may proceed to 514. At 514, method 500 may include indicating that the canister module(s) are functioning as desired. In some examples, such an indication may include indicating that all of the canister modules are functioning as desired. However, in other example refueling events where not all of the canister modules are expected to experience a temperature rise, such an indication may include indicating that the modules that were predicted to experience a temperature rise are all functioning as desired.

Returning to 512, if one or more of the indicated temperature changes do not correspond to the expected temperature profiles based on the amount of fuel added to the tank during the refueling event, method 500 may proceed to 516. At 516, method 500 includes identifying the modules with an indicated temperature change that is not equal to the expected temperature change. For example, if a certain canister module was expected to change by a determined amount, but instead the temperature change is lower than the determined amount, such a canister module may be identified as a module with potential degradation. In another example, a canister module may have been predicted to have a certain expected temperature change, yet the actual indicated temperature change may be greater than the expected temperature change. Such a canister may also be identified, and its position in relation to other canister modules indicated.

Proceeding to 518, method 500 includes processing the information from step 516 of method 500 in order to indicate which fuel vapor modules may not be functioning as desired. For example, a canister module with a temperature rise that is less than the expected temperature rise may be indicated to be not functioning as desired. However, in another example, a canister module downstream of the direction of the adsorption front (e.g., closer to the canister vent line) that is also downstream of a module indicated to be degraded, may have an altered temperature rise profile as the result of a lower overall amount of fuel vapors adsorbed by the canister module indicated to be degraded. In such an example, the canister module downstream of the canister module indicated to be degraded may in fact adsorb more fuel vapors than expected/predicted, resulting in a temperature rise greater than expected if all modules were functioning as desired. As such, the controller may further process the acquired temperature signals and expected temperature rise profiles, in order to indicate whether a module downstream of a module indicated to be degraded is functioning as desired. For example, the expected temperature rise profile may be adjusted accordingly, and may be done so for each individual module. In such an example, where a module is indicated to be degraded, the next module downstream may thus be expected to adsorb a greater amount of vapor, as discussed. As such, if the temperature rise indicated during the refueling event does not correspond to the greater amount of vapor adsorbed by the canister module, then that particular module may also be indicated to be degraded. In similar fashion, each of the individual canister modules may be assessed as to whether they are functioning as desired.

Accordingly, at 518, method 500 may include setting a diagnostic trouble code, and may further include illuminating a MIL in order to alert the vehicle operator that one or more canister modules are not functioning as desired, and of the need to replace said modules. In this way, maintenance on individual canister modules may be achieved, thereby reducing maintenance costs and maintenance time when compared to maintenance of an entire fuel vapor canister. Furthermore, as discussed above with regard to step 510 of method 500, in some examples Peltier elements positioned within each individual canister module may be selectively activated in order to indicated whether the indicated degradation is due to the temperature sensor(s) not functioning as desired, or whether the temperature sensor(s) are functioning as desired but that the adsorbent within a module indicated to be degraded is not functioning as desired.

Proceeding to 520, method 500 may include adjusting vehicle parameters to mitigate canister degradation, as discussed above with regard to step 511 of method 500. Briefly, adjusting vehicle parameters may include operating the vehicle propulsion system in an electric only mode as frequently as possible, controlling the fuel tank isolation valve and/or canister vent valve to reduce fuel vapors traveling to the canister, or purging fuel tank vapor directly to the intake manifold of the engine during engine operation, to reduce fuel vapors routed to the canister. In some examples, the vehicle parameter adjustments may be further based on the degree to which the modular canister is degraded. For example, a fuel vapor canister with only one module indicated to be not functioning as desired may not necessitate mitigating action other than alerting the operator to replace the one module, as most fuel vapors may be captured and stored efficiently by the other modules. In other examples however, even if one module is indicated to be not functioning as desired, then mitigating action may be taken as described above.

FIG. 6 depicts an example fueling event of a fuel system (e.g., fuel system 18 at FIG. 1) and a corresponding diagnosis of fuel vapor canister module degradation of a modular fuel vapor canister comprising four modules. Specifically, map 600 depicts fuel level within a fuel tank at plot 610, temperature signals within a plurality of canister modules composing a first example fuel vapor canister at plot 620, and temperature signals within a plurality of canister modules composing a second example fuel vapor canister at plot 630. Plot 610 depicts the fuel level increasing along the direction of the y-axis, while plots 620 and 630 depict temperatures increasing along the direction of the y-axis. As one example, with reference to fuel system 18 at FIG. 1, fuel level may be determined based on signals from a fuel level sensor (e.g., 106) located in the fuel tank (e.g., 20) that may be configured to provide an indication of the fuel level to the controller (e.g., 12). With reference to a modular fuel vapor canister (e.g., 222 at FIG. 2), temperature signals may be provided by temperature sensors embedded within each module of the canister (e.g., temperature sensors 232, 234, and 236 embedded within modules 202, 204, and 206). All plots are depicted as functions of time, along the x-axis.

The curves at plot 620 are illustrative of a modular fuel vapor canister that may include one degraded canister module, while the curves at plot 630 are illustrative of a modular fuel vapor canister that may include general degradation of the canister. As will be discussed below, each plot includes lines (e.g., 623, 625, 627, 629, 629*a*) corresponding to expected temperature rise profiles, the expected temperature rise profiles generated based on the concepts described in detail with regard to method 400 and method 500.

Turning now to plot 620, curves 622, 624, 626, and 628 illustrate temperature signals corresponding to a sequential arrangement of first, second, third, and fourth canister modules. As one example, curve 622 corresponds to a purge/vapor module (e.g., 202 at FIG. 2), curve 628 corresponds to a vent module (e.g., 206 at FIG. 2), and curves 624 and 626 correspond to intermediate modules (e.g., 204 at FIG. 2). Before time t1, fueling has not begun and the temperature signals may remain stable at a cooler temperature. However, as described above with regard to FIG. 4, prior to refueling the tank, a fuel level may be recorded, a current loading state of each of the individual modules may be recorded, and temperature thresholds corresponding to saturation levels of each individual module, may be determined.

At t1, a fueling event begins. Thus, fuel vapors may enter the fuel vapor canister from the fuel tank and result in temperature changes within the fuel vapor canister.

Between times t1 and t2, fuel level 612 increases as a result of the fuel vapors entering the fuel vapor canister. During this time, temperature signals within the fuel vapor canister are monitored. As shown, curve 622, corresponding to purge/vapor module (e.g., 202 at FIG. 2), increases and then declines between time t1 and t2. Curve 624, corresponding to an intermediate module positioned next to purge/vapor module, increases and the indicated temperature increase is maintained between time t1 and t2. However, curve 626, corresponding to an intermediate module positioned next to the module depicted by curve 624, does not rise substantially between time t1 and t2. While curve 626 is not indicated to rise substantially, curve 628, corresponding to a vent module (e.g., 206 at FIG. 2) is indicated to rise between time t1 and t2. It will be appreciated that curve 622 increases before curve 624, which increases before curve 628. In other words, the temperatures within each module rise in a sequential order. As such, based on the indicated temperature rise profiles, an indication of which canister module(s) may not be functioning as desired, may be indicated, as discussed below and with regard to the methods depicted in FIG. 4 and FIG. 5.

At time t2, the fueling event ends, as indicated by the fuel level reaching the capacity of the fuel tank, and as further indicated by the fuel level plateauing for a duration. As described above, the end of a refueling event may be further indicated by the removal of a fuel dispenser from the fuel filler neck, the replacement of a fuel cap, closing of a fuel door, etc. Accordingly, at time t2, an amount of fuel that was added to the fuel tank during the course of the refueling event may be indicated. Accordingly, as described above with regard to FIG. 4, an expected temperature rise profile for each module may be generated based on the amount of fuel added to the tank, taking into account canister loading state prior to the refueling event and adjusted temperature thresholds corresponding to canister saturation levels. As such, temperature rise profiles may be set subsequent to the end of the refueling event. For example, the first canister module, corresponding to curve 622, may be expected to rise to temperature threshold 623. As the indicated temperature 622 rose to the expected temperature 623, the first canister module may be indicated to be functioning as desired. Similarly, the second canister module (e.g., first intermediate canister module), corresponding to curve 624, may be expected to rise to temperature threshold 625. As the indicated temperature 624 rose to the expected temperature 625, the second canister module may be indicated to be functioning as desired. However, the third canister module (e.g., second intermediate canister module), corresponding to curve 626 may be expected to rise to temperature threshold 627, however indicated temperature 626 did not rise to the expected temperature threshold 627, as indicated specifically by the arrow between lines 627 and 626. As such, a substantial amount of fuel vapors that were predicted to be adsorbed by the third canister module were not in fact adsorbed, which may thus be adsorbed downstream of the third canister module, as discussed below. As such, because the third canister module 626 did not rise to the expected temperature 627, the third canister module may be indicated to be degraded. Furthermore, expected temperature profiles may need to be adjusted based on the fact that an amount of fuel vapors that were expected to be adsorbed by the third canister module were not, in fact, adsorbed. For example, if the first through third canister modules were all functioning as desired, then the expected temperature rise in the fourth canister module corresponding to a vent module (e.g., 206 at FIG. 2) may be indicated line 629. However, because a substantial amount of fuel vapor that was expected to be adsorbed by the third canister module was not adsorbed, the expected temperature rise in the fourth canister may need to be adjusted. As such, the expected temperature rise 629 may be adjusted to expected temperature rise 629*a*, to compensate for the fact that the third canister module is not functioning as desired. As shown, indicated temperature in the fourth canister module, represented by curve 628, rose to the adjusted expected temperature rise 629*a*. As such, the fourth canister module may be indicated to be functioning as desired. Accordingly, it may thus be indicated that the first, second, and fourth canisters are functioning as desired, but that the third canister is not functioning as desired. As discussed above, in some examples a diagnostic trouble code may be set and a malfunction indicator light may be illuminated to alert the vehicle operator of the need to service the canister. For example, because only one module was indicated to be not functioning as desired, only the one module may be replaced, thus potentially reducing overall costs associated with parts and labor for servicing the modular fuel vapor canister. Furthermore, as one canister module was indicated to not be functioning as desired, mitigating action may be taken, as discussed above with regard to step 520 of method 500.

Turning now to plot 630, curves 632, 634, 636, and 638 illustrate temperature signals corresponding to a sequential arrangement of first, second, third, and fourth canister modules. As one example, curve 632 corresponds to a purge/vapor module (e.g., 202 at FIG. 2), curve 638 corresponds to a vent module (e.g., 206 at FIG. 2), and curves 634 and 636 correspond to intermediate modules (e.g., 204 at FIG. 2). Before time t1, fueling has not begun and the temperature signals may remain stable at a cooler temperature. However, as described above with regard to FIG. 4, prior to refueling the tank, a fuel level may be recorded, a current loading state of each of the individual modules may be recorded, and temperature thresholds corresponding to saturation levels of each individual module, may be determined.

At t1, a fueling event begins. Thus, fuel vapors may enter the fuel vapor canister from the fuel tank and result in temperature changes within the fuel vapor canister.

Between times t1 and t2, fuel level 612 increases as a result of the fuel vapors entering the fuel vapor canister. During this time, temperature signals within the fuel vapor canister are monitored. As shown, however, between time t1 and t2, very little temperature change is recorded by the temperature sensors positioned in each individual module, as represented by curves 632, 634, 636, and 638. As such, even though fuel is continually added to the tank, where fuel vapors are expected to be routed to the fuel vapor canister to be adsorbed, no adsorption is indicated, as no temperature changes are observed.

At time t2, the fueling event ends, where the end of refueling may be indicated as discussed above. Accordingly, at time t2, an amount of fuel that was added to the fuel tank during the course of the refueling event may be indicated. As described above with regard to FIG. 4, an expected temperature rise profile for each module may be generated based on the amount of fuel added to the tank, taking into account canister loading state prior to the refueling event and adjusted temperature thresholds corresponding to canister saturation levels. As such, temperature rise profiles may be set subsequent to the end of the refueling event. Line 633 represents an expected temperature rise for the first canister module 632. Line 635 represents an expected temperature rise for the second canister module 634. Line 637 represents an expected temperature rise for the third canister module 636, and line 639 represents an expected temperature rise for the fourth canister module 638. However, none of the canister modules were indicated to reach the expected temperature, based on the level of fuel added to the tank, and indicated loading state of the individual modules. As such, none of the modules are indicated to be functioning as desired, and a general degradation of the modular fuel vapor canister may be indicated. As discussed above, such an indication may include setting a diagnostic trouble code, and may include illuminating a malfunction indicator light in order to alert the vehicle operator of general fuel vapor canister degradation and of the need to replace the canister. Furthermore, mitigating actions may be undertaken, as described above with regard to step 511 of method 500.

While the methods described above (e.g., method 400 and method 500) depict example methods for determining whether one or more individual canister modules are functioning as desired during a refueling event, another potential opportunity to diagnose the functionality of individual canister modules may include a canister purge event. For example, as described above, when purging conditions are met, such as when the canister load is above a threshold, and/or when intake manifold vacuum is above a threshold, vapors stored in the fuel vapor canister (e.g., 222) may be purged to engine intake (e.g., 23) by commanding open a canister purge valve (e.g., 112) and a canister vent valve (e.g., 114). During such a purge event, if the loading state of individual canister modules are known prior to commencing the purge event, then based on the duration and aggressiveness of the purge event, an expected temperature change for each individual canister module may be determined, and responsive to deviations in the measured temperature changes from the expected temperature changes, it may be determined whether individual canister modules are functioning as desired.

Turning now to method 700, a flow chart for a high level example method 700 for diagnosing whether any number of individual canister modules in a modular fuel vapor canister are functioning as desired, is shown. More specifically, prior to a canister purge event, a loading state of each individual canister module may be indicated. Subsequent to completion of the purge event, based on an indicated duration and aggressiveness of the purge operation, an expected temperature decrease, or an expected rate of temperature decrease, in each canister module may be determined. Deviations in the actual measured temperature decrease(s) in an individual canister (as measure by temperature sensors as discussed above) from the expected temperature decrease may be indicative of that canister module not functioning as desired. In other words, method 700 includes desorbing fuel vapors in a plurality of individual vapor storage modules connected together in series, the individual vapor storage modules comprising a modular fuel vapor canister which is coupled to a fuel tank; and evaluating performance of each the individual modules responsive to a monitored temperature change being different than an expected temperature change in the individual modules during the desorption of fuel vapors. Method 700 may be carried out by a controller, such as controller 12 in FIG. 1, and may be stored at the controller as executable instructions in non-transitory memory. Instructions for carrying out method 700 and the rest of the methods included herein may be executed by the controller based on instructions stored on a memory of the controller and in conjunction with signals received from sensors of the engine system, such as the sensors described above with reference to FIG. 1 and FIG. 2. The controller may employ fuel system and evaporative emissions system actuators, such as fuel tank isolation valve (e.g., 110), canister vent valve (e.g., 114), and canister purge valve (e.g., 112), etc., according to the method below.

Method 700 begins at 701 and includes evaluating current operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc. Continuing at 703, method 700 may include indicating whether canister purging conditions are met. Purge conditions may include an engine-on condition, canister load above a threshold, an intake manifold vacuum above a threshold, an estimate or measurement of temperature of an emission control device such as a catalyst being above a predetermined temperature associated with catalytic operation commonly referred to as light-off temperature, a non-steady state engine condition, and other operating conditions that would not be adversely affected by a canister purge operation. If, at 703, purge conditions are not met, method 700 may proceed to 705, and may include maintaining current engine, evaporative emissions system, and fuel system status. For example, if it is indicated that the vehicle engine is off, the engine may be maintained off. In another example, if it is indicated that the vehicle engine is on, engine operation may be maintained according to current engine operating conditions. Furthermore, at 705, maintaining fuel system and evaporative emissions system status may include maintaining a canister purge valve (e.g., 112), fuel tank isolation valve (e.g., 110), and canister vent valve (e.g., 114), in their current configurations. Method 700 may then end.

Returning to 703, if it is indicated that canister purge conditions are met, method 700 may proceed to 708. At 708, method 700 may include recording the current loading state of each individual module of the modular fuel vapor canister. For example, as described above, each canister module may comprise a different adsorbent, with differing adsorbent capacities. Furthermore, loading state may vary between individual modules based on the position of modules within the modular fuel vapor canister. Accordingly, in order to accurately assess the functionality of each individual module subsequent to a purge event, the loading state of each individual module may need to be determined prior to the start of the purge event. As described above, a loading state of each individual canister module may be indicated based on temperature sensors imbedded in each individual canister module. In some examples, the loading state of each individual canister module may be stored at the controller (e.g., 12). By storing the loading state of each individual canister module prior to purging the canister, expected temperature changes in each individual module may be correlated with actual temperature changes in each individual module subsequent to the purge event, where deviations in measured values from expected values may indicate that certain modules are not functioning as desired, as will be discussed in greater detail below.

Subsequent to recording the current loading state of each individual module at 708, method 700 may proceed to 711. At 711, method 700 may include commanding open the CPV (e.g., 112), and commanding open or maintaining open the canister vent valve (e.g., 114). Furthermore, if the fuel system includes a fuel tank isolation valve (e.g., 110), the fuel tank isolation valve may be maintained closed. However, in some examples the fuel tank isolation valve may additionally be commanded open (for example if pressure in the fuel tank is above a threshold), such that fuel vapors from the fuel tank may additionally be purged to engine intake.

Proceeding to 714, method 700 may include purging the canister. At 714, purging the canister may include indicating an air/fuel ratio via, for example, a proportional plus integral feedback controller coupled to a two-state exhaust gas oxygen sensor, and responsive to the air/fuel indication and a measurement of inducted air flow, generating a base fuel command. To compensate for purge vapors, a reference air/fuel ratio, related to engine operation without purging, may be subtracted from the air/fuel ratio indication and the resulting error signal (compensation factor) generated. As such, the compensation factor may represent a learned value directly related to fuel vapor concentration, and may be subtracted from the base fuel command to correct for the induction of fuel vapors. The duration of the purging operation may be based on the learned value (or compensation factor) of the vapors such that when it is indicated there are no appreciable hydrocarbons in the vapors (the compensation is essentially zero), the purge may be ended. In other examples, a purge operation may be discontinued responsive to purge conditions no longer being met, for example if intake manifold vacuum decreases below a threshold value. In addition, in some examples the canister purge valve may be duty cycled, to control an overall amount and duration of the canister purge event. For example, increasing the canister purge valve duty cycle may be considered a more "aggressive" purge event, while decreasing the canister purge valve duty cycle may be considered a "less aggressive" purge event.

Proceeding to 717, method 700 may include monitoring temperature signals from each of the individual modules during the purge event. The temperature signals may be recorded at the controller, such that the signals may be processed subsequent to the purge event, as will be described in further detail below. As discussed above, during a purge event, desorption of fuel vapors from the adsorbent material(s) in the canister results in a cooling effect, which can be monitored by the temperature sensors. As such, the temperature signals recorded during the purge event may represent temperature decreases responsive to the release of hydrocarbons from the adsorbent material.

Proceeding to 721, method 700 may include indicating whether the purge event is complete. As discussed above, the purge event may be indicated to be complete responsive to a learned indication that an appreciable amount of fuel vapors are no longer present in the purge flow. In other examples, the purge event may be indicated to be complete responsive to a sudden change in intake manifold vacuum, wherein the purge conditions are no longer met. Furthermore, in some examples a purge event may be indicated to be complete responsive to an absence of any further temperature change in the fuel vapor canister, as monitored by the temperature sensors positioned therein. For example, if the temperature change as monitored by the temperature sensors plateaus for a duration, it may be indicated that the purge event is complete. In some examples, one or more of the above-described approaches may be utilized alone or in conjunction with one another in order to indicate when a purge event may be considered complete. If, at 721, the purge event is not indicated to be complete, method 700 may return to 714, where the canister purging may be continued. However, if at 721 it is indicated that the canister purging event is complete, method 700 may proceed to 724, and may include commanding closed the canister purge valve (e.g., 112). By commanding closed the canister purge valve, the canister may be sealed from engine intake, thus terminating the purge event.

Proceeding to 727, method 700 may include calculating an expected temperature change value for each individual canister module based on the duration and aggressiveness of the purge event. Similar to the concepts presented above with regard to the refueling event, expected temperature change may be further based on the canister load of each individual canister module before commencing the purge event. Furthermore, the expected temperature change may be further based on the type and adsorbent capacity of the adsorbent housed in each individual canister module. As an example, consider two canister modules that are both indicated to be loaded with fuel vapor, but wherein one canister module contains an adsorbent with a much lower adsorbent capacity than the other. In such an example, an expected temperature change for the module with a lower adsorption capacity may be lower than the expected temperature change for the module with the higher adsorption capacity, under circumstances where the purge duration and aggressiveness is the same for both canister modules. In this way, an expected temperature change (e.g., temperature decrease) for each module may be calculated subsequent to the purge event. Furthermore, in some examples the expected temperature change may comprise an expected rate of temperature change, whereas in other examples the expected temperature change may comprise an absolute temperature change.

Proceeding to 730, method 700 may include indicating whether the expected temperature change (either an absolute temperature change or a rate of temperature change) matches the recorded temperature change. Such a comparison may be carried out by the controller (e.g., 12). Accordingly, if at 730 it is indicated that the measured temperature change in each module matches the expected temperature change, method 700 may proceed to 733. At 733, method 700 may include indicating that all canister modules are functioning as desired. Method 700 may then end.

Alternatively, if at 730 it is indicated that the measured temperature change in one or more individual modules does not match the expected temperature change, then method 700 may proceed to 736. At 736, method 700 may include identifying modules with a temperature change that does not match the expected temperature change. In one example, a measured rate of temperature change in one or more individual modules may not match an expected rate of temperature change. For example, the measured rate of temperature change may be in some examples faster, and in some examples slower, than the expected rate of temperature change. In further examples, a measured absolute temperature change may not match an expected absolute temperature change. In still further examples, the measured rate of temperature change and the measured absolute temperature change may both not match an expected rate/absolute temperature change. In examples where a measured rate of temperature change or a measured absolute temperature change that does not match an expected rate of temperature change or an expected absolute temperature change for an individual canister module, expected rates of temperature change or expected absolute temperature change in one or more of the remaining canister modules may be thus modified accordingly. For example, if a measured rate of temperature change or a measured absolute temperature change in a canister module close to the vent line does not match the expected rate of temperature change or the expected absolute temperature change, then expected rates of temperature change or expected absolute temperature change for the remaining modules may be adjusted to account for the module close to the vent line not functioning as desired. Such compensations may be carried out by the controller, for example. As a more specific example, consider a first canister module near the vent line where a very small temperature change is indicated during a purge event, whereas a much larger temperature change (rate or absolute change) was expected. As such, the first canister may be indicated to be not functioning as desired. However, because the first canister is not functioning as desired, the expected rates of change for one or more canister modules downstream may be affected. Furthermore, an expected absolute temperature change for the one or more remaining canister modules may similarly be affected. As such, it may be understood that the expected rates of temperature change or expected absolute temperature changes in the individual modules may be determined initially based on the canister loading state and adsorption capacity of each individual module, in conjunction with purge duration and aggressiveness, but which may be further modified based on the measured temperature changes (or rates of temperature change) in each individual module.

Proceeding to 739, method 700 may include indicating that one or more modules are not functioning as desired, based on measured rates of temperature change or measured absolute temperature change deviating from expected rates of temperature change or expected absolute temperature change. In one example, as discussed above, at 739, method 700 may include setting a diagnostic trouble code, and may further include illuminating a MIL in order to alert the vehicle operator that one or more canister modules are not functioning as desired, and of the need to replace said modules. In this way, maintenance on individual canister modules may be achieved, thereby reducing maintenance costs and maintenance time when compared to maintenance of an entire fuel vapor canister. Furthermore, as discussed above with regard to step 510 of method 500, in some examples Peltier elements positioned within each individual canister module may be selectively activated in order to indicated whether the indicated degradation is due to the temperature sensor(s) not functioning as desired, or whether the temperature sensor(s) are functioning as desired but that the adsorbent within a module indicated to be degraded is not functioning as desired.

Proceeding to 741, method 700 may include adjusting vehicle parameters to mitigate canister degradation, as discussed above. Briefly, adjusting vehicle parameters may include operating the vehicle propulsion system in an electric only mode as frequently as possible, controlling the fuel tank isolation valve and/or canister vent valve to reduce fuel vapors traveling to the canister, or purging fuel tank vapor directly to the intake manifold of the engine during engine operation, to reduce fuel vapors routed to the canister. In some examples, the vehicle parameter adjustments may be further based on the degree to which the modular canister is degraded. For example, a fuel vapor canister with only one module indicated to be not functioning as desired may not necessitate mitigating action other than alerting the operator to replace the one module, as most fuel vapors may be captured and stored efficiently by the other modules. In other examples however, even if one module is indicated to be not functioning as desired, then mitigating action may be taken as described above.

Turning now to FIG. 8, an example purging event for a modular fuel vapor canister (such as fuel vapor canister 222 at FIG. 2), is shown. The vapor purging event may follow routine 700, shown at FIG. 7. Specifically, map 800 depicts the position (e.g., open or closed) of a canister purge valve (e.g., 112) at plot 810. Map 800 further depicts monitored temperature signals within a plurality of individual canister modules during a purge event at plot 820. Plot 810 depicts the position of the canister purge valve 812 with a degree of openness increasing along the direction of the y-axis, while plots 820 and 830 depict temperatures increasing along the direction of the y-axis. With reference to modular fuel vapor canister 222 at FIG. 2, temperature signals may be provided by temperature sensors embedded within each module of the canister (e.g., temperature sensors 232, 234, and 236 embedded within modules 202, 204, and 206). All plots are depicted as functions of time, along the x-axis.

Turning to plot 820, curves 822, 824, 826, and 828 illustrate temperature signals corresponding to a sequential arrangement of first, second, third, and fourth canister modules (the first canister module closest to the vent line and the fourth canister module closest to the purge line). For example, curve 822 corresponds to a vent module (e.g., 206 at FIG. 2), curves 824 and 826 correspond to intermediate modules (e.g., 204 at FIG. 2), and curve 828 corresponds to a purge/load module (e.g., 202 at FIG. 2). Before time t1, purging has not begun and the temperature signals may remain stable at a warmer temperature.

At t1, a purge event begins responsive to canister purge conditions being met. As described above with regard to method 700, purge conditions may include an engine-on condition, canister load above a threshold, an intake manifold vacuum above a threshold, an estimate or measurement of temperature of an emission control device such as a catalyst being above a predetermined temperature associated with catalytic operation commonly referred to as light-off temperature, a non-steady state engine condition, etc. As described above, responsive to purge conditions being met, the current loading state of each individual canister module of the modular fuel vapor canister may be recorded. Such an indication may be based on temperature sensors imbedded in each individual canister module, and the loading state of each individual canister module may be stored at the controller (e.g., 12). As discussed above, by storing the loading state of each individual canister module prior to purging the canister, expected temperature changes in each individual module may be correlated with actual temperature changes in each individual module subsequent to the purge event, where deviations in measured values from expected values may indicate that certain modules are not functioning as desired. As such, subsequent to the recording of the current loading state of each individual canister module, the canister purge valve is commanded open at time t1. While in this example illustration the canister purge valve is indicated to be fully opened at time t1, in other examples it may be understood that the canister purge valve may be duty cycled (e.g., alternately opened and closed), where the duty cycle may be increased or decreased, where increasing the duty cycle purges the canister more rapidly and where decreasing the duty cycle purges the canister less rapidly. For illustration purposes however, the canister purge valve is indicated to be opened fully at time t1. Furthermore, while not explicitly illustrated, it may be understood that a canister vent valve (e.g., 114) may be commanded open or maintained open at time t1, and a fuel tank isolation valve (e.g., 110), may be commanded closed or maintained closed at time t1. As discussed above, by commanding open the canister purge valve with the canister vent valve open, intake manifold vacuum may draw fresh air across the modular fuel vapor canister, where the fresh air drawn across the adsorbent material in the individual canister modules serves to desorb stored fuel vapor, the desorbed fuel vapor thus routed to engine intake to be combusted in the engine. Furthermore, as discussed above, the desorption of fuel vapor is an endothermic process, thus resulting in a temperature decrease in the vicinity of desorbed fuel vapor, where the temperature decrease may be monitored by the temperature sensors embedded within each module of the canister.

With the canister purge valve and canister vent valve open at time t1, the drawing of fresh air across the modular fuel vapor canister begins to desorb stored fuel vapor, starting with the first canister module 822 positioned closest to the vent line. As such, temperature within the first canister module 822 begins to decrease shortly after the canister purge valve is commanded open. Positioned next to the first canister module 822 is the second canister module 824. As second canister module 824 is the second closest individual canister module to the vent line, fuel vapors are next desorbed from second canister module 824, as indicated by a decrease in temperature in said module. Positioned next to the second canister module 824 is third canister module 826. Based on the position of third canister module 826, it may be expected that a temperature decrease in third module 826 may follow the temperature decrease indicated in second module 824. However, very little temperature decrease is indicated. As such, as discussed above, it is likely that third canister module 826 is not functioning as desired. Such an assessment may be determined subsequent to completion of the purging event, as discussed above and which will be discussed in further detail below. Positioned next to the third canister module 826 is fourth canister module 828. Based on the position of fourth canister module 828, it may be expected that a temperature decrease in fourth canister module 828 may follow temperature decreases in the first, second, and third canister modules. Accordingly, a temperature decrease is observed within the fourth canister module 828, indicating that fuel vapors are being desorbed from said module during the purging operation.

At time t2, the purge event is completed. As discussed above, a purge event may be indicated to be complete responsive to a learned indication that an appreciable amount of fuel vapors are no longer present in the purge flow, responsive to a sudden change in intake manifold vacuum, or responsive to an indication of an absence of any further temperature change in the fuel vapor canister. For example, if the temperature change as monitored by the temperature sensors plateaus for a duration, it may be indicated that the purge event is complete. As discussed above, in some examples, one or more of the above-described approaches may be utilized alone or in conjunction with one another in order to indicate when a purge event may be considered complete. As the purge event is completed, at time t2 the canister purge valve 812 is commanded closed.

Between time t2 and t3, an expected temperature change value for each individual canister module may be calculated. As discussed above and with regard to FIG. 7, expected temperature change may be based on the duration and aggressiveness of the purge event. Furthermore, the expected temperature change in each individual canister module may be further based on the canister load of each individual module before the purge event was initiated, and may be further based on the type and adsorbent capacity of the adsorbent housed in each individual canister module. As such, an expected temperature change may be calculated subsequent to the purge event between time t2 and t3. As discussed, such and expected temperature change may comprise an expected rate of temperature change within each module, an expected absolute temperature change within each module, or a combination of expected rate and absolute temperature change for each individual module.

Accordingly, expected temperature changes within each module may be set at time t3. For illustration purposes, expected temperature changes will be shown herein as absolute temperature changes, however it may be understood that expected rates of temperature change may be similarly utilized without departing from the scope of the present disclosure. As such, line 823 corresponds to a calculated expected temperature change within first canister module 822. Line 825 corresponds to a calculated expected temperature change within second canister module 824. Line 827 corresponds to a calculated expected temperature change within third canister module 826. Line 829 corresponds to a calculated expected temperature change within fourth canister module 828. As will be described further below line 829*a* corresponds to an adjusted expected temperature change within fourth canister module 828, based on an indication that one of the canister modules is not functioning as desired.

With the expected temperature changes for each module set at time t3, it may be determined whether the expected temperature change for each individual module matches the recorded temperature change. As discussed above, such a comparison may be carried out by the controller (e.g., 12). If all of the calculated expected temperature changes match the temperature changes measured in each individual module, then it may be indicated that all of the individual modules are functioning as desired. However, in this illustrative example, the measured temperature change in one of the individual canister modules (third canister module 826) does not match the expected temperature change within said module. For example, expected temperature change for the first canister module 822 is indicated by line 823, and the measured temperature change in the first canister module is indicated to have matched the expected temperature change. Similarly, expected temperature change for the second canister module 824 is indicated by line 825, and the measured temperature change in the second canister module is indicated to have matched the expected temperature change. Moving on to the third canister module 826 however, the expected temperature change within the third canister module is indicated by line 827, yet the measured temperature change within third canister module 826 during the purge event did not match the expected temperature change. Accordingly, it may be indicated that the third canister module is not functioning as desired. As the third canister module is not indicated to be functioning as desired, a diagnostic trouble code may be set, and a malfunction indicator light may be illuminated, thus alerting the operator of the vehicle of the need to replace the third canister module. Furthermore, based on the initial loading state of all canister modules and the duration and aggressiveness of the purge event, an expected temperature change for the fourth canister module 828 is indicated by line 829. However, because the third canister module did not function as desired, controller may take into account the difference between the expected temperature change for the third module, and the actual temperature change for the third module, and such information may be used to calculate an adjusted expected temperature change for the fourth canister module, as discussed above. Accordingly, expected temperature change for the fourth canister module may be adjusted to a new expected temperature change, represented by line 829*a*. With an adjusted expected temperature set for the fourth canister module, the measured temperature change within fourth canister module 828 may be compared to the adjusted expected temperature change 829*a*. As the measured temperature change within the fourth canister module 828 matched the adjusted expected temperature change 829*a* for the fourth canister module, it may be indicated that the fourth canister module is functioning as desired.

In this way, during a refueling event, or during a purging event, individual canister modules within a modular fuel vapor canister may be reliably assessed as to whether each individual canister module is functioning as desired. By enabling an ability to diagnose the functionality of individual modules, in a case where it is determined that one or more modules are not functioning as desired, only the modules that are not functioning as desired may be serviced and/or replaced, which may thus reduce overall servicing costs and replacement costs. For example, replacing one module in a modular canister may be significantly cheaper than replacing an entire canister. By using the methodology depicted herein and with regard to FIG. 4, FIG. 5, and FIG. 7, an accurate assessment of what fuel vapor canister modules may need replacing may be indicated, where the methods are not intrusive to vehicle function but instead take advantage of conditions and circumstances that reliably and regularly take place during vehicle operation, namely refueling events and purging events.

FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

The technical effect of implementing a modular fuel vapor canister in a vehicle is the recognition that, with temperature sensors positioned within the individual fuel vapor canister modules, a canister loading state may be determined either before a refueling event, or before a purge event, and such information may be utilized to determine which individual modules are functioning as desired subsequent to completion of the refueling event or subsequent to completion of the purging event. For example, with a canister loading state known prior to a refueling event, based on the amount of fuel added to the tank during the refueling event (along with the amount/adsorbent capacity of the adsorbent within each individual canister module), individual canister modules may be assessed as to whether they are functioning as desired depending on a correlation between expected temperature change and measured temperature change within each module. In similar lines, with a canister loading state known prior to a purge event, based on the duration and aggressiveness of the purge event (along with the amount/adsorbent capacity of the adsorbent within each individual canister module), individual canister modules may be assessed as to whether they are functioning as desired depending on a correlation between expected temperature change and measure temperature change within each module. As such, the use of a modular fuel vapor canister may serve to reduce overall costs, increase lifetime of fuel vapor canisters, may result in reduced undesired evaporative emissions, as compared to non-modular fuel vapor canisters, and may enable the capacity of the canister to be readily adjusted based on emissions standards.

The systems described herein and with reference to FIGS. 1-3B, along with the methods described herein and with reference to FIGS. 4-5 and FIG. 7, may enable one or more systems and one or more methods. In one example, a method comprises adsorbing fuel vapors or desorbing fuel vapors in a plurality of individual vapor storage modules which are coupled to a vehicle fuel tank; monitoring a plurality of temperature sensors each coupled to one of the individual modules; and indicating that one or more of the individual modules are not functioning as desired responsive to a monitored temperature change being different than an expected temperature change during the adsorbing or desorbing of fuel vapors. In a first example of the method, the method further includes wherein adsorbing fuel vapors in the individual vapor storage modules occurs during refueling of the vehicle fuel tank, where fuel vapors generated during the refueling are directed to the individual vapor storage modules for adsorption; and wherein adsorbing fuel vapors results in a temperature increase in one or more of the plurality of individual vapor storage modules. A second example of the method optionally includes the first example and further includes wherein desorbing fuel vapors in the individual vapor storage modules occurs during a purge event, where the purge event further comprises coupling the individual vapor storage modules to an engine intake manifold and to atmosphere to draw fresh air across the individual vapor storage modules such that stored fuel vapors are desorbed and routed to the engine intake manifold for combustion; and wherein desorbing fuel vapors results in a temperature decrease in one or more of the plurality of individual vapor storage modules. A third example of the method optionally includes any one or more or each of the first and second examples and further comprises prior to the adsorbing or desorbing of fuel vapors in the individual vapor storage modules, recording a loading state of each individual module, where the loading state includes an indication of a fuel vapor saturation level within each individual module. A fourth example of the method optionally includes any one or more or each of the first through third examples and further comprises wherein the expected temperature change is based on the loading state of each individual module prior to the adsorbing or desorbing of fuel vapors. A fifth example of the method optionally includes any one or more or each of the first through fourth examples and further includes wherein the expected temperature change is further based on an expected amount of fuel vapors adsorbed or desorbed by individual modules during the adsorbing or desorbing. A sixth example of the method optionally includes any one or more or each of the first through fifth examples and further includes wherein responsive to an indication that one or more of the individual vapor storage modules are not functioning as desired, the one or more individual vapor storage modules that are not functioning as desired can be replaced without replacing remaining modules. A seventh example of the method optionally includes any one or more or each of the first through sixth examples and further includes wherein each individual module is fluidically coupled to at least one other individual module; wherein at least one temperature sensor is positioned within each individual module; wherein each individual module houses adsorbent material for capturing and storing fuel vapors from the vehicle fuel tank; and wherein the adsorbent material within each individual module can differ between the individual modules.

Another example of a method comprises adsorbing fuel vapors or desorbing fuel vapors in a plurality of individual vapor storage modules connected together in series, the individual vapor storage modules comprising a modular fuel vapor canister which is coupled to a fuel tank; and evaluating performance of each the individual modules responsive to a monitored temperature change being different than an expected temperature change in the individual modules during either the adsorption of fuel vapors or the desorption of fuel vapors. In a first example of the method, the method further includes wherein the expected temperature change corresponds to a refueling event where fuel vapors generated in the fuel tank are routed to the fuel vapor canister for storage; and wherein the expected temperature change is related to the amount of fuel added to the tank. A second example of the method optionally includes the first example and further comprises recording a loading state of each individual module of the modular fuel vapor canister prior to the refueling event; and wherein the expected temperature change in each individual canister module is further related to the loading state of each individual canister module prior to the refueling event. A third example of the method optionally includes any one or more or each of the first and second examples and further includes wherein the expected temperature change corresponds to a fuel vapor canister purging event where the modular fuel vapor canister is coupled to an intake manifold and to atmosphere to route fuel vapors from the modular fuel vapor canister to the intake manifold; and wherein the expected temperature change is related to the duration of the fuel vapor canister purging event. A fourth example of the method optionally includes any one or more or each of the first through third examples and further comprises recording a loading state of each individual module of the modular fuel vapor canister prior to the purging event; and wherein the expected temperature change in each individual module is related to the loading state of each individual canister module prior to the purging event. A fifth example of the method optionally includes any one or more or each of the first through fourth examples and further includes wherein evaluating performance of each the individual modules responsive to a monitored temperature change being different than an expected temperature change includes indicating that one or more of the individual modules are not functioning as desired; where an individual module not functioning as desired includes an adsorbent material in the one or more individual canister modules being degraded, or a temperature sensor in the one or more individual modules being non-functional. A sixth example of the method optionally includes any one or more or each of the first through fifth examples and further includes wherein responsive to an indication that one or more of the individual modules are not functioning as desired: activating a heating element within the one or more individual modules; and indicating that the temperature sensor in the one or more individual modules is functional responsive to an indicated temperature change corresponding to the heating element being activated.

An example of a fuel vapor canister, comprises: a plurality of individual canister modules forming a modular fuel vapor canister, said canister modules sequentially arranged in series and releasably physically coupled; wherein each canister module is filled with a vapor adsorbent material; wherein a first end module is positioned at a first end of the sequential arrangement; wherein a second end module is positioned at a second end of the sequential arrangement; and wherein a plurality of intermediate modules are positioned between the first end module and the second end module. In a first example, the vapor canister further includes wherein the first end module includes a first port and a second port at a first end, where the first end module is physically coupled to an intermediate module at a second end; wherein each of the plurality of intermediate modules is physically coupled to a first canister module at a first end, and is physically coupled to a second canister module at a second end; and wherein the second end module is physically coupled to an intermediate module at a first end, and includes a third port at a second end. In a second example, the vapor canister optionally includes the first example and further includes wherein the first port is selectively fluidly coupled to a fuel tank; wherein the second port is selectively fluidly coupled to an intake manifold of a vehicle engine; and wherein the third port is selectively fluidly coupled to atmosphere. In a third example, the vapor canister optionally includes any one or more or each of the first and second examples and further comprises at least one temperature sensor embedded within each individual canister module. A fourth example of the vapor canister optionally includes any one or more or each of the first through third examples and further includes wherein the at least one temperature sensors are configured to indicate a temperature within each individual canister module to a controller; wherein the controller is a controller storing instructions in non-transitory memory, that when executed, cause the controller to: indicate that one or more of the individual modules are not functioning as desired responsive to a monitored temperature change being different than an expected temperature change during an adsorbing or a desorbing of fuel vapors; wherein the adsorbing of fuel vapors occurs during a fuel tank refueling event; and wherein the desorbing of fuel vapors occurs during a canister purge event.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

adsorbing fuel vapors or desorbing fuel vapors in a plurality of individual vapor storage modules coupled to a vehicle fuel tank, wherein each of the plurality of individual vapor storage modules is releasably physically coupled to at least one other of the plurality of individual vapor storage modules;

monitoring a plurality of temperature sensors each coupled to one of the plurality of individual vapor storage modules; and indicating that one or more of the plurality of individual vapor storage modules are not functioning as desired responsive to a monitored temperature change being different than an expected temperature change during the adsorbing or desorbing of fuel vapors.

2. The method of claim 1, wherein adsorbing fuel vapors in the individual vapor storage modules occurs during refueling of the vehicle fuel tank, where fuel vapors generated during the refueling are directed to the individual vapor storage modules for adsorption; and wherein adsorbing fuel vapors results in a temperature increase in one or more of the plurality of individual vapor storage modules.

3. The method of claim 1, wherein desorbing fuel vapors in the plurality of individual vapor storage modules occurs during a purge event, where the purge event further comprises coupling the plurality of individual vapor storage modules to an engine intake manifold and to atmosphere to draw fresh air across the individual vapor storage modules such that stored fuel vapors are desorbed and routed to the engine intake manifold for combustion; and wherein desorbing the fuel vapors results in a temperature decrease in one or more of the plurality of individual vapor storage modules.

4. The method of claim 1, further comprising:

prior to the adsorbing or desorbing of fuel vapors in the plurality of individual vapor storage modules, recording a loading state of each individual vapor storage module, where the loading state includes an indication of a fuel vapor saturation level within each individual vapor storage module.

5. The method of claim 4, wherein the expected temperature change is based on the loading state of each individual vapor storage module prior to the adsorbing or desorbing of fuel vapors.

6. The method of claim 5, wherein the expected temperature change is further based on an expected amount of fuel vapors adsorbed or desorbed by the plurality of individual vapor storage modules during the adsorbing or desorbing of fuel vapors.

7. A method comprising:

adsorbing fuel vapors or desorbing fuel vapors in a plurality of individual vapor storage modules coupled to a vehicle fuel tank, monitoring a plurality of temperature sensors each coupled to one of the plurality of individual vapor storage modules; and indicating that one or more of the plurality of individual vapor storage modules are not functioning as desired responsive to a monitored temperature change being different than an expected temperature change during the adsorbing or desorbing of fuel vapors, wherein, responsive to an indication that one or more of the plurality of individual vapor storage modules are not functioning as desired, the one or more of the plurality of individual vapor storage modules that are not functioning as desired can be replaced without replacing remaining vapor storage modules.

8. The method of claim 1, wherein each individual vapor storage module is fluidically coupled to at least one other individual vapor storage module;

wherein at least one temperature sensor is positioned within each individual vapor storage module;

wherein each individual vapor storage module houses adsorbent material for capturing and storing fuel vapors from the vehicle fuel tank; and wherein the adsorbent material within each individual vapor storage module can differ between the individual vapor storage modules.

9. A method comprising:

via a controller with instructions stored in non-transitory memory, adsorbing fuel vapors or desorbing fuel vapors in a plurality of individual vapor storage modules releasably physically connected together in series, the plurality of individual vapor storage modules comprising a modular fuel vapor canister which is coupled to a fuel tank; and evaluating performance of each of the plurality of individual vapor storage modules responsive to a monitored temperature change being different than an expected temperature change in the plurality of individual vapor storage modules during either the adsorption of fuel vapors or the desorption of fuel vapors.

10. The method of claim 9, wherein the expected temperature change corresponds to a refueling event where fuel vapors generated in the fuel tank are routed to the fuel vapor canister for storage; and wherein the expected temperature change is related to an amount of fuel added to the fuel tank.

11. The method of claim 10, further comprising:

recording a loading state of each individual module of the modular fuel vapor canister prior to the refueling event; and wherein the expected temperature change in each individual module is further related to the loading state of each individual module prior to the refueling event.

12. The method of claim 9, wherein the expected temperature change corresponds to a fuel vapor canister purging event where the modular fuel vapor canister is coupled to an intake manifold and to atmosphere to route fuel vapors from the modular fuel vapor canister to the intake manifold; and wherein the expected temperature change is related to a duration of the fuel vapor canister purging event.

13. The method of claim 12, further comprising:

recording a loading state of each individual vapor storage module of the modular fuel vapor canister prior to the purging event;

wherein the expected temperature change in each individual vapor storage module is related to the loading state of each individual vapor storage module prior to the fuel vapor canister purging event.

14. The method of claim 9, wherein evaluating the performance of each of the plurality of individual vapor storage modules responsive to the monitored temperature change being different than the expected temperature change includes indicating that one or more of the plurality of individual vapor storage modules are not functioning as desired; and wherein an individual vapor storage module not functioning as desired includes an adsorbent material in the one or more of the plurality of individual vapor storage modules being degraded, or a temperature sensor in the one or more of the plurality of individual vapor storage modules being non-functional.

15. The method of claim 14, wherein, responsive to the indication that one or more of the plurality of individual vapor storage modules are not functioning as desired:

activating a heating element within the one or more of the plurality of individual vapor storage modules; and indicating that the temperature sensor in the one or more of the plurality of individual vapor storage modules is functional responsive to an indicated temperature change corresponding to the heating element being activated.

* * * * *